US009358596B2

(12) United States Patent
Schell et al.

(10) Patent No.: US 9,358,596 B2
(45) **Date of Patent: *Jun. 7, 2016**

(54) EDGE GUIDE MECHANISM AND PANEL FORMING MACHINE INCORPORATING THE SAME

(71) Applicant: Mazzella Holding Company, Inc., Cleveland, OH (US)

(72) Inventors: Ronald W. Schell, Firestone, CO (US); Brandon Tatum, Denver, CO (US); Adam J. Binderup, Westminster, CO (US)

(73) Assignee: Mazzella Holding Company, Inc., Cleveland, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/502,262

(22) Filed: Sep. 30, 2014

(65) Prior Publication Data

US 2015/0101384 A1 Apr. 16, 2015

Related U.S. Application Data

(63) Continuation of application No. 13/027,094, filed on Feb. 14, 2011, now Pat. No. 8,844,333.

(51) Int. Cl.

| | |
|---|---|
| ***B21D 43/02*** | (2006.01) |
| ***B21B 39/12*** | (2006.01) |
| ***B21D 19/04*** | (2006.01) |
| ***B21B 39/14*** | (2006.01) |
| ***B21D 5/08*** | (2006.01) |

(52) U.S. Cl.

CPC ..... *B21B 39/14* (2013.01); *B21B 39/12* (2013.01); *B21D 5/08* (2013.01); *B21D 19/04* (2013.01); *B21D 43/023* (2013.01)

(58) Field of Classification Search

CPC ..... B21D 5/12; B21D 19/02; B21D 19/04; B21D 43/023; B21B 39/12; B21B 39/14

See application file for complete search history.

(56) References Cited

U.S. PATENT DOCUMENTS

| | | | | |
|---|---|---|---|---|
| 2,339,355 | A * | 1/1944 | Rutten | B21D 5/08 72/129 |
| 3,479,852 | A * | 11/1969 | Conrad | B21D 19/005 72/234 |
| 5,394,722 | A | 3/1995 | Meyer | |
| 5,425,259 | A | 6/1995 | Coben et al. | |
| 5,740,687 | A | 4/1998 | Meyer et al. | |
| 6,772,616 | B2 | 8/2004 | Cunningham et al. | |
| 6,843,092 | B2 * | 1/2005 | Greenberg | B21D 11/206 72/166 |

* cited by examiner

*Primary Examiner* — Teresa M Ekiert

(74) *Attorney, Agent, or Firm* — Roger D. Emerson; Emerson Thomson Bennett, LLC

(57) ABSTRACT

A forming machine for forming a longitudinal margin of a strip of material into a desired profile and methods encompassing the steps inherent in the described mechanical structures and operation thereof. The forming machine includes a frame, a drive mechanism, a plurality of forming elements, and an edge guide mechanism. The edge guide mechanism applies pressure along the edge margin in a lateral direction, thereby following the edge margin as the strip is advanced through the machine. The edge guide includes a carriage assembly attached to the frame that comprises a carriage support frame and a carriage movably disposed thereon. The edge guide mechanism includes an actuator connected to the carriage that is operative to urge the carriage toward edge margin. At least one guide roller is mounted to the carriage and adapted to receive the edge margin of the strip.

19 Claims, 25 Drawing Sheets

EDGE GUIDE MECHANISM AND PANEL FORMING MACHINE INCORPORATING THE SAME

BACKGROUND

Material forming machines play a significant role in modern industry and include, for example, machines which stamp, roll, form, cut and extrude metal, to name a few. One type of machine, and the type to which the present invention is directed, receives an elongate strip of material at an entryway and advances the strip of material progressively through the machine against longitudinally positioned forming elements to configure longitudinal margins of the strip into desired useful cross-sections, or profiles. After formation, the strip is discharged at an exit location.

Existing material forming machines typically have an enclosed frame with a plurality of frame members extending around and defining a forming region with an entryway and an exit. Material being formed may extend into the entryway and out of the exit but it cannot extend unobstructed to the side of the forming region. The frame supports a drive assembly for advancing the strip of material in a downstream direction from the entrance to the exit. The drive assembly is coupled to one or more pairs of co-acting rollers centrally located along the pathway of the strip. Also in existing material forming machines it is known to provide a plurality of forming rollers disposed along the pathway of the strip to configure one or both margins into a desired profile. This is accomplished by progressively bending the margins into a particular shape. After formation, the strip is discharged at an exit location, and a shear may be positioned at the exit to cut preformed material into selected lengths.

A representative shear assembly is described, for example, in U.S. Pat. No. 5,740,687 issued Apr. 21, 1998 to Meyer et al. The '687 patent has been assigned to New Tech Machinery Corp. of Denver, Colo., the assignee of the present invention. The strips of material that are fed into the machine may either be at discrete lengths or, as is more typically the case, a continuous feed is provided from a coil, such as a coil of metal to be formed. The formed strip is then cut into usable lengths at the exit location or downstream end of the machine. Specific examples of such apparatus include commercial/residential roof panel forming machines, gutter forming machines, siding panel forming machines and soffit panel forming machines.

The plurality of forming rollers are sometimes independently mounted to the framework at selected locations, but another technique involves grouping forming elements together as forming station sets along the pathway of the strip. For example, in U.S. Pat. No. 5,425,259 issued Jun. 20, 1995 to Coben et al., also assigned to New Tech, a forming machine is disclosed for bending strips wherein an elongated rail structure is removably secured within the interior of the framework of the machine and its removable out, for example, the one entrance or exit of the framework. The rail structure is mounted at discrete mounting locations that are spaced laterally of the drive mechanism, and a plurality of forming elements are disposed on the rail structure to define at least two longitudinally spaced forming stations. The rail structure is removable from the framework without detaching the forming stations. Alternative sets of rail structures can then be interchangeably mounted in the framework as forming sets to allow formation of different profiles without the need to individually change each forming station. Representative forming machines which incorporate the use of such features are available from New Tech Machinery under the designations "SSP MultiPro", "SSH MultiPro", "SSR MultiPro Jr.", "5VC 5V Crimp" and "FWM Flush Wall".

While forming machines have been quite useful and effective in fabricating metal strips into shaped members, such as panels and gutters, in the past such machines were only able to form a single profile so that the fabricator would have to require separate machines for each profile desired to be configured, or for each change of dimensions within a given profile. Alternatively, the entire set of forming elements would need to be replaced by individually detaching each forming element or, in certain cases, by replacing a forming station box comprising a set of forming rollers. In U.S. Pat. No. 5,394,722 issued Mar. 7, 1995 to Meyer, an apparatus for forming profiles on strip materials is disclosed wherein a standard profile can be formed of two different sizes or physical dimensions. The machine shown in the '722 patent utilizes rollers that may be positioned toward and apart from one another for selected spacing between the two relative positions, thereby to selectively vary the profile formed.

A further advancement in the art of material forming machines is described in U.S. Pat. No. 6,772,616 issued Aug. 10, 2004 to Cunningham et al., also assigned to the assignee of the present invention. This patent describes a forming machine wherein greater flexibility of fabrication is achieved because the machine is constructed to accommodate a variety of different sets of metal forming stations mounted as sets on rail structures, or support beams, so that the different sets may be easily interchanged to allow fabrication of different panel profiles. As such, an easily adjustable forming machine is described for varying profile dimensions, such as profile height and profile separation, with a minimum of downtime for the machine during a changeover.

While forming machines have been quite useful and effective in fabricating metal strips into shaped members, such as roof panels and gutters, in the past such machines were only able to handle rectangular strips due to the enclosed frame and fixed guides of traditional machines. Thus, traditional forming machines cannot easily facilitate forming edge profiles on tapered panels, such as tapered roof panels. Tapered roof panels are used to form cone shaped or frustoconical roof portions. Tapered panels are also used to follow curved roof contours. The tapered panels are aligned vertically from the base of the cone to the top. The necessary edge profiles of a tapered panel may be formed with a sheet metal brake. However, forming multiple tapered panels with a brake is time consuming, labor intensive, and prone to user error.

Accordingly, there is a need for a cost effective and versatile tapered panel forming machine that is capable of forming edge profiles on tapered panels.

SUMMARY

Described herein is a roll forming machine adapted to form a longitudinal margin of a strip of material into a desired profile. The roll forming machine includes a frame including a forming region through which the strip may be advanced from an upstream entrance to a downstream exit. A drive mechanism is mounted to the frame and operative to engage the strip and advance the strip in a downstream direction from the entrance to the exit. An elongate rail structure is mounted to the frame and spaced laterally from the drive mechanism. A plurality of forming elements are mounted to the rail structure to define at least one forming station that is positioned to engage the longitudinal margin and operative to progressively form the longitudinal margin into the desired profile as the strip is advanced through the forming region by the drive mechanism. A guide roller station, also referred to as an edge guide mechanism, accommodates an edge margin of the strip that is opposite the longitudinal margin. The edge guide mechanism is operative to apply horizontal pressure along the edge margin in a lateral direction, thereby following the edge margin as the strip is advanced through the forming region.

The frame includes an elongate vertical side frame portion with upper and lower frame portions extending horizontally from the vertical side frame such that the frame is open on a side opposite the vertical side frame. The frame may include a stationary edge guide disposed proximate the entrance. The edge guide mechanism is operative to urge the longitudinal margin against the stationary edge guide as the strip is advanced through the forming region. The frame may include a plurality of support rails to support the strip as it advances through the forming region. Some of the support rails may be disposed outboard of the frame to support the tapered margin of the strip. The roll forming machine may include attachments such as a support stand, an input table, and an output table.

The edge guide mechanism includes a floating edge guide that moves laterally to follow the edge of the strip. The edge guide mechanism includes a carriage assembly attached to the frame and operative to apply horizontal pressure in a lateral direction along the edge margin. The carriage assembly comprises a carriage support frame attached to the roll forming machine and a carriage movably disposed on the carriage support frame. The carriage is movable such that the distance between the guide rollers and the stationary edge guide varies between first and second widths of the tapered strip. The edge guide mechanism includes an actuator, such as a pneumatic actuator, connected to the carriage that is operative to urge the carriage toward the elongate rail structure. At least one guide roller is mounted to the carriage and adapted to receive the edge margin of the strip. In an embodiment, a pair of the guide rollers are mounted on a guide bar that is pivotably mounted on the carriage whereby both the guide rollers are capable of receiving a profile of the edge margin.

Also contemplated herein are methods of forming a desired profile into a longitudinal margin of a tapered strip of material. In an embodiment, a method comprises providing an stationary edge guide and a set of forming rollers, wherein the stationary edge guide is positioned relative the forming rollers in order to locate the longitudinal margin of the tapered strip of material such that the forming rollers engage the longitudinal margin. The tapered strip of material is advanced into the forming rollers to progressively form the longitudinal margin into the desired profile. Horizontal pressure is applied in a lateral direction to an edge margin of the tapered strip of material that is opposite the longitudinal margin thereby holding the longitudinal margin against the stationary edge guide.

These and other aspects will be apparent after consideration of the Detailed Description and Figures herein. It is to be understood, however, that the scope of the invention shall be determined by the claims as issued.

BRIEF DESCRIPTION OF THE DRAWINGS

Non-limiting and non-exhaustive embodiments of the present invention, including the preferred embodiment, are described with reference to the following figures, wherein like reference numerals refer to like parts throughout the various views unless otherwise specified.

DETAILED DESCRIPTION

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and the invention should not be construed as being limited to the embodiments set forth herein. The following detailed description is, therefore, not to be taken in a limiting sense.

Figure 1:
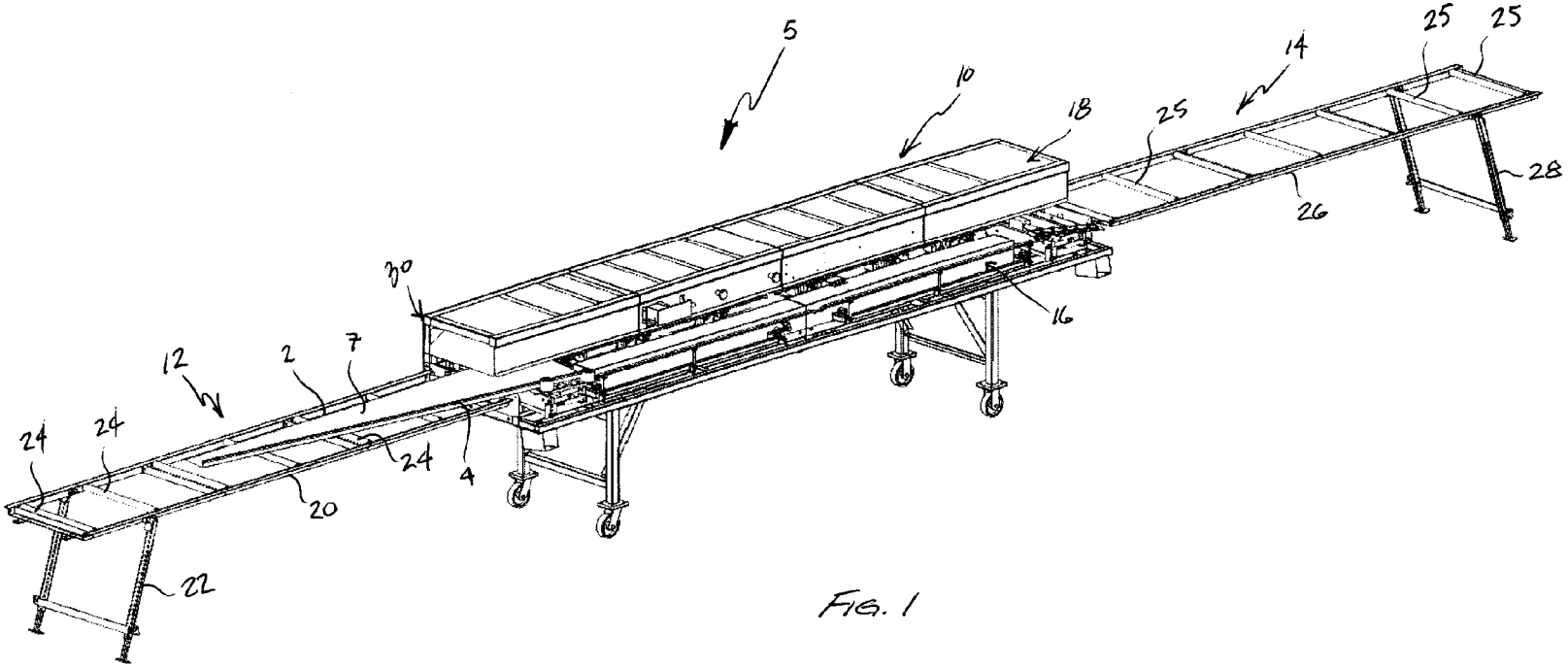
FIG. 1 is a perspective view of a roll forming apparatus according to an exemplary embodiment.

FIG. 1 illustrates a roll forming apparatus 5 comprising a roll forming machine 10 and accessory attachments in the form of an upstream support table 12 and a downstream support table 14. Roll forming machine 10 is adapted to form a longitudinal margin 2 of a strip of material, such as tapered panel 7, into a desired profile. Roll forming machine 10 may include various protective covers, such as tooling cover 18 and drive assembly cover 16.

Support tables 12 and 14 are respectively positioned proximate the upstream and downstream openings of forming machine 10. Frame 20 of upstream support table 12 is mounted to roll forming machine frame 30 at one end and supported at the other end by leg assembly 22. Frame 26 of downstream table 14 is similarly mounted to frame 30 at one end and supported at the other end by leg assembly 28. Mounting the tables to the frame may include, for example and without limitation, attaching the table to frame 30 with fasteners; supporting the end of the table on frame 30 with hooks or latches, for example; engaging a receptacle on either the table or the frame; use of a bracket or mount; or otherwise mating the table to frame 30 such that the table is supported on one end. Leg assemblies 26 and 28 are foldable with respect to their corresponding frames and may include extendable legs. Panel support tables 12 and 14 also include a plurality of longitudinally spaced apart rollers 24 and 25 respectively. Upstream table 12 supports a sheet material panel 7 as it is fed into the roll forming machine 10. Downstream table 14 receives the panel as it exits the roll forming machine 10.

Figure 2:
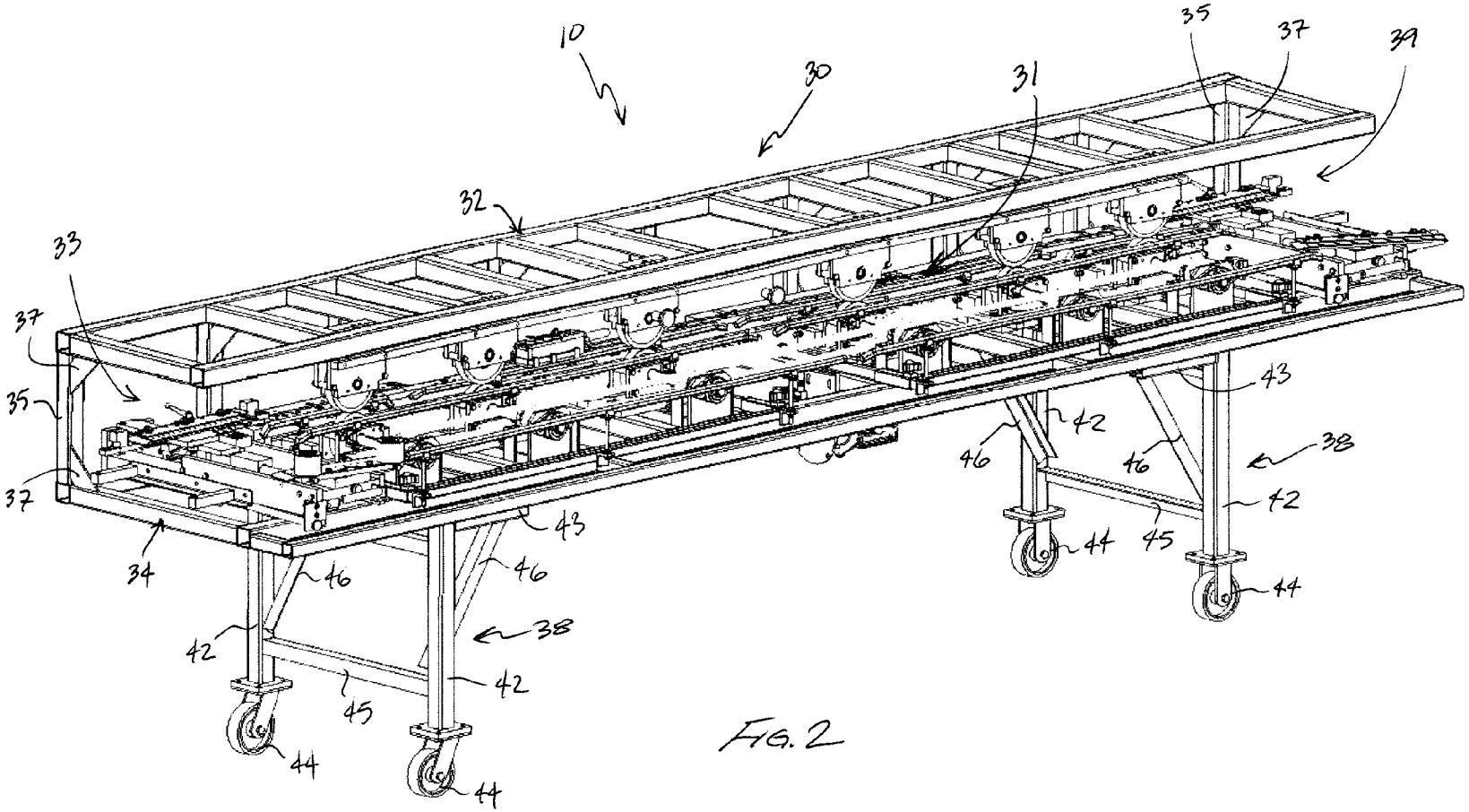
FIG. 2 is a perspective view of the roll forming machine shown in FIG. 1 with the cover panels removed for clarity.

As shown in FIG. 2, frame 30 includes upper frame portion 32 and lower frame portion 34. The frame portions are vertically spaced apart and connected by a plurality of longitudinally spaced vertical frame members 35. Each frame member 35 is reinforced with a plurality of gusset plates 37 as shown in the figure. Frame members 35 define an elongate vertical side frame portion with the upper and lower frame portions (32, 34) extending horizontally from said vertical side frame portion such that said frame is open on a side 31 opposite said vertical frame members 35. Entryway 33 is the upstream or feed side of frame 30. Accordingly, exit opening 39 is the downstream or exit side of frame 30. The frame portions and vertical frame members 35 partially enclose a forming region through which strip 7 is advanced from the upstream entrance to the downstream exit. An enclosed frame includes a plurality of frame members extending around and defining a forming region with an entryway and an exit. Material being formed may extend into the entryway and out of the exit but it cannot extend unobstructed to the side of the forming region. In this case, the frame is open such that material may extend to the side of the forming region without being obstructed by any frame members. Therefore, the forming machine disclosed herein may form sheets of material much wider than the forming machine itself.

Also shown in FIG. 2 are a pair of frame support assemblies 38. The frame support assemblies 38 attach to the lower frame portion 34 and support the roll forming machine 10 at a convenient working height. Each frame support assembly 38 includes a pair of legs 42 that extend from a corresponding base member 43. Cross bars 45 extend between adjacent legs. Gusset members 46 extend between the legs 42 and their corresponding base members 43. Leg assemblies 38 may also include a pair of wheels or casters 44 as shown in FIG. 2.

Frame 30 may be constructed of steel tubing that is welded together in the described configuration. As is known in the art, frame 30 also includes a plurality of tabs and mounts for attaching various components of the roll forming machine 10 and ancillary components, such as the panel support tables 12, 14, and frame support assemblies 38. These tabs and mounts may be welded to the frame. The components or assemblies that mate to each of these tabs and mounts are generally fastened thereto with appropriate hardware, such as for example and without limitation, screws, bolts, nuts, and washers.

Figure 3:
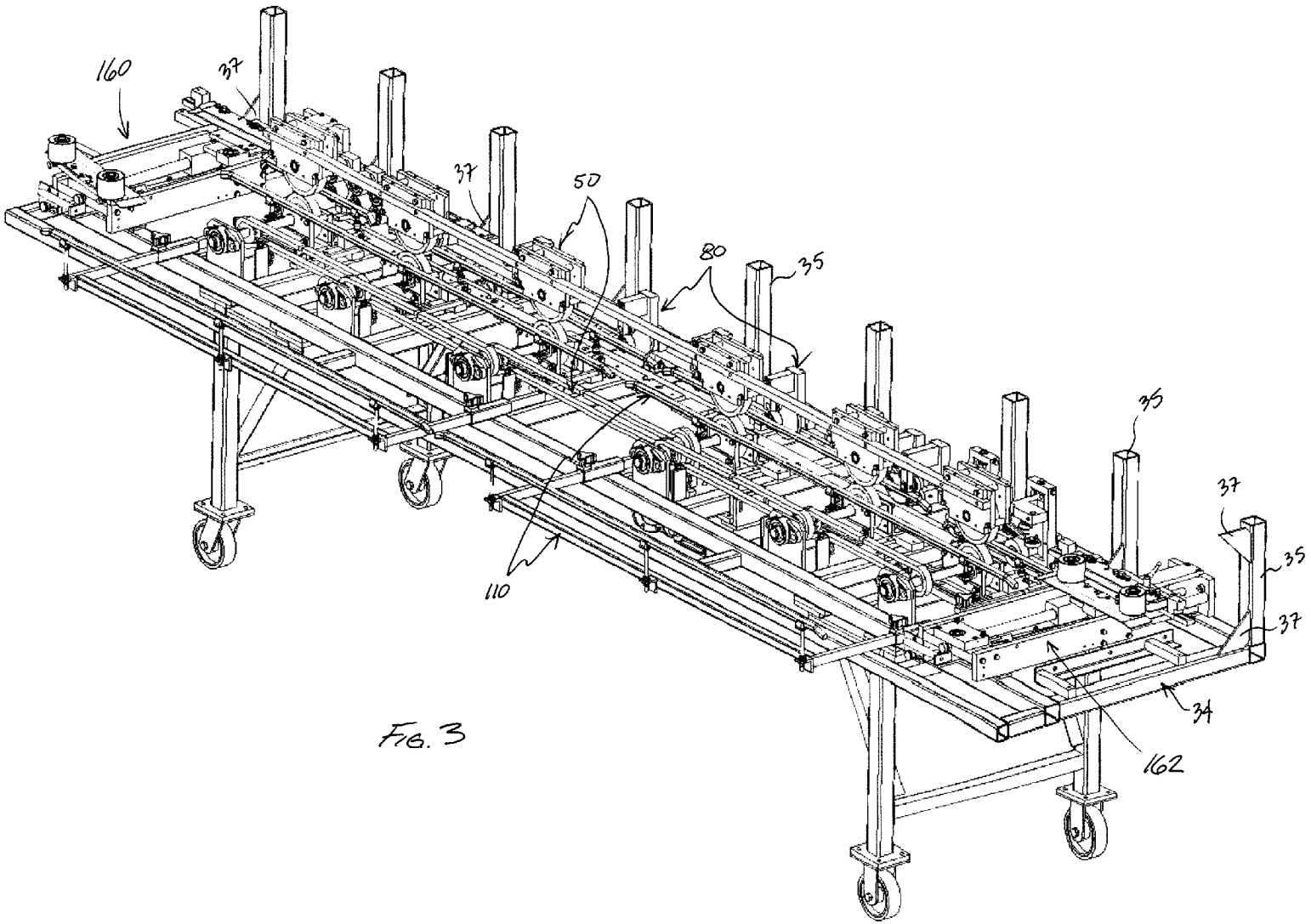
FIG. 3 is a perspective view of the roll forming machine shown in FIG. 2 with the upper frame portion removed.

FIG. 3 is a perspective view showing the roll forming machine 10 without the upper frame portion 32 so that the relationship of the various assemblies that comprise the roll forming machine may be better appreciated. The roll forming machine 10 includes a drive mechanism assembly 50 that is operative to engage strip 7 and advance the strip through the forming region in a downstream direction from the entrance 33 to the exit 39. Tooling assembly 80 includes a plurality of forming elements positioned to engage the longitudinal margin 2 of strip 7 and progressively form the margin into the desired profile as the strip is advanced through the forming region. The roll forming machine 10 also includes a support rail assembly 110 that is operative to support the strip above the lower frame portion 34 as the strip is advanced through the forming machine. Edge guide mechanism 160 receives the edge margin 4 of the strip that is opposite the longitudinal margin 2 and is operative to apply horizontal pressure along the edge margin 4 in a lateral direction, thereby following the edge margin 4 as the strip is advanced through the forming region. Roll forming machine 10 may also include an exit edge guide mechanism 162.

Figure 4:
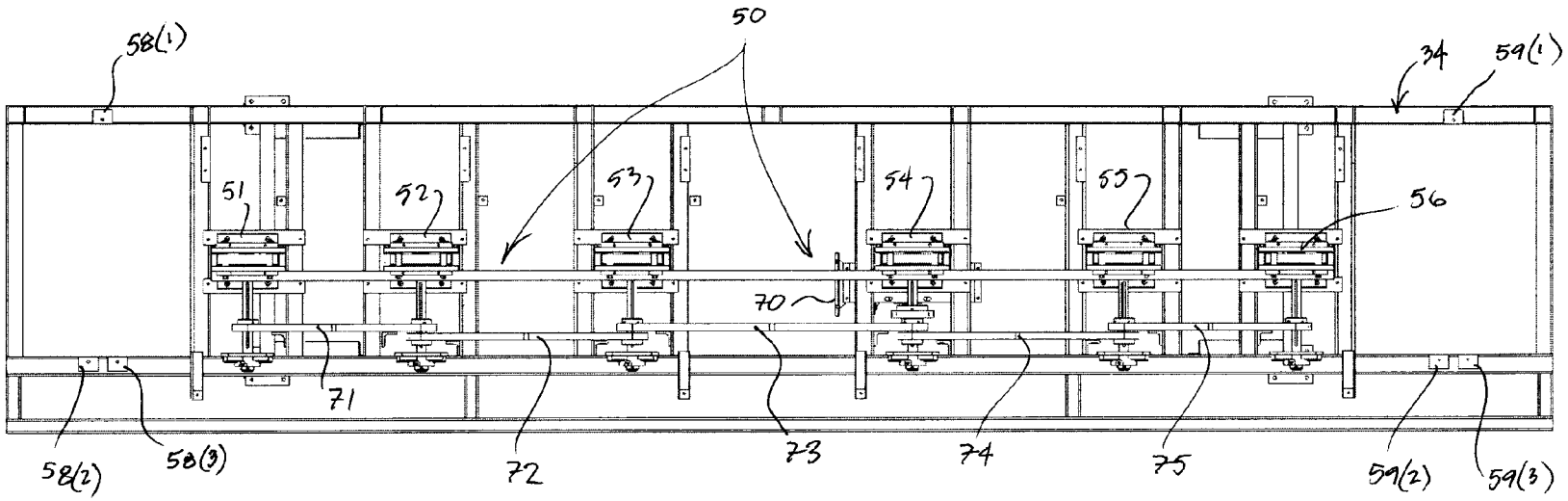
FIG. 4 is top plan view illustrating the drive assembly of the roll forming machine shown in FIG. 3 with the tooling assembly and support rail assembly removed for clarity.
Figure 5:
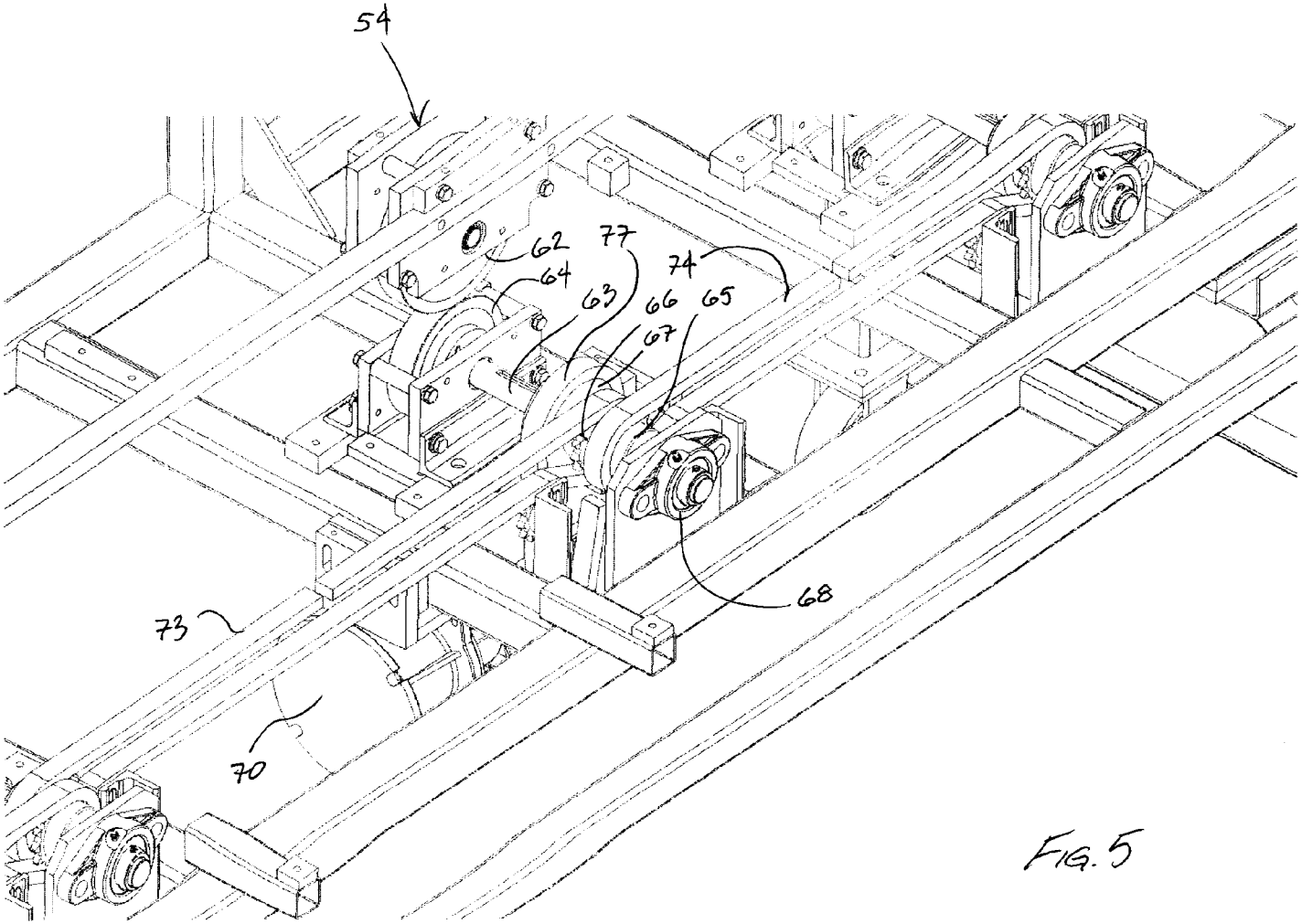
FIG. 5 is an enlarged partial perspective view of the drive assembly shown in FIG. 4.

With reference to FIG. 4, the drive mechanism assembly 50 includes a plurality of drive stations 51-56 that are mechanically coupled to each other by chains 71-75 as shown in the figure. Roll forming drive mechanisms are well known in the art and are described in, for example, U.S. Pat. No. 5,740,687, issued Apr. 21, 1998, entitled FORMING APPARATUS FOR STRIP MATERIALS, the disclosure of which is hereby incorporated by reference in its entirety. With further reference to representative drive station 54 shown in FIG. 5, each drive station includes a lower drive roller 64 and an upper idler roller 62. The upper and lower rollers cooperate to grip a central portion of the strip 7 in order to advance the material through the machine. Preferably rollers 62 and 64 include a circumferential layer of polyurethane or other resilient material to assist with gripping the strip 7. Drive roller 64 is mounted to a drive shaft 63 that is mounted in a pair of bearings 68. At least one sprocket is mounted to the drive shaft to engage a chain or chains to interconnect the drive stations 51-56. In this case, drive station 54 includes three sprockets 65, 66, and 67. Sprockets 65 and 66 engage chains 74 and 73 respectively to mechanically connect station 54 with adjacent stations 53 and 55. Sprocket 67 engages chain 77 which connects drive station 54 to a drive sprocket (not shown) associated with the motor and gear reducer assembly 70. Mounting the sprockets to the shafts, supporting shafts in the bearings, and tensioning the chains may be accomplished with, for example, appropriate keys, fasteners, and tensioners as is well known in the art.

It should be appreciated that idler rollers 62 and drive rollers 64 are relatively narrow in width when compared to traditional forming machine drive rollers. Accordingly, the overall width of the forming machine 10 may be reduced. Furthermore, the narrow width of the rollers allows the machine to form tapered panels and narrow straight panels because the width of sheet material taken up by the rollers is reduced. Rollers 62 and 64 are approximately 1 1/16 inches wide compared to earlier roller widths of approximately 3½ inches.

Figure 6:
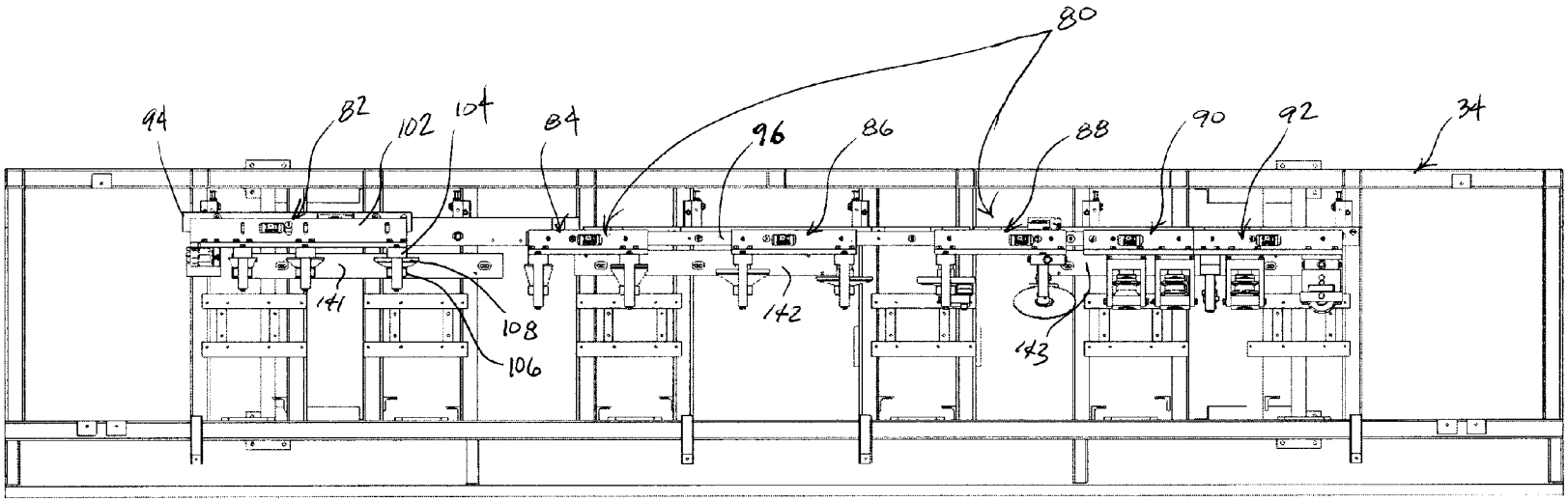
FIG. 6 is top plan view illustrating the tooling assembly of the roll forming machine shown in FIG. 3 with the drive assembly and support rail assembly removed for clarity.
Figure 7:
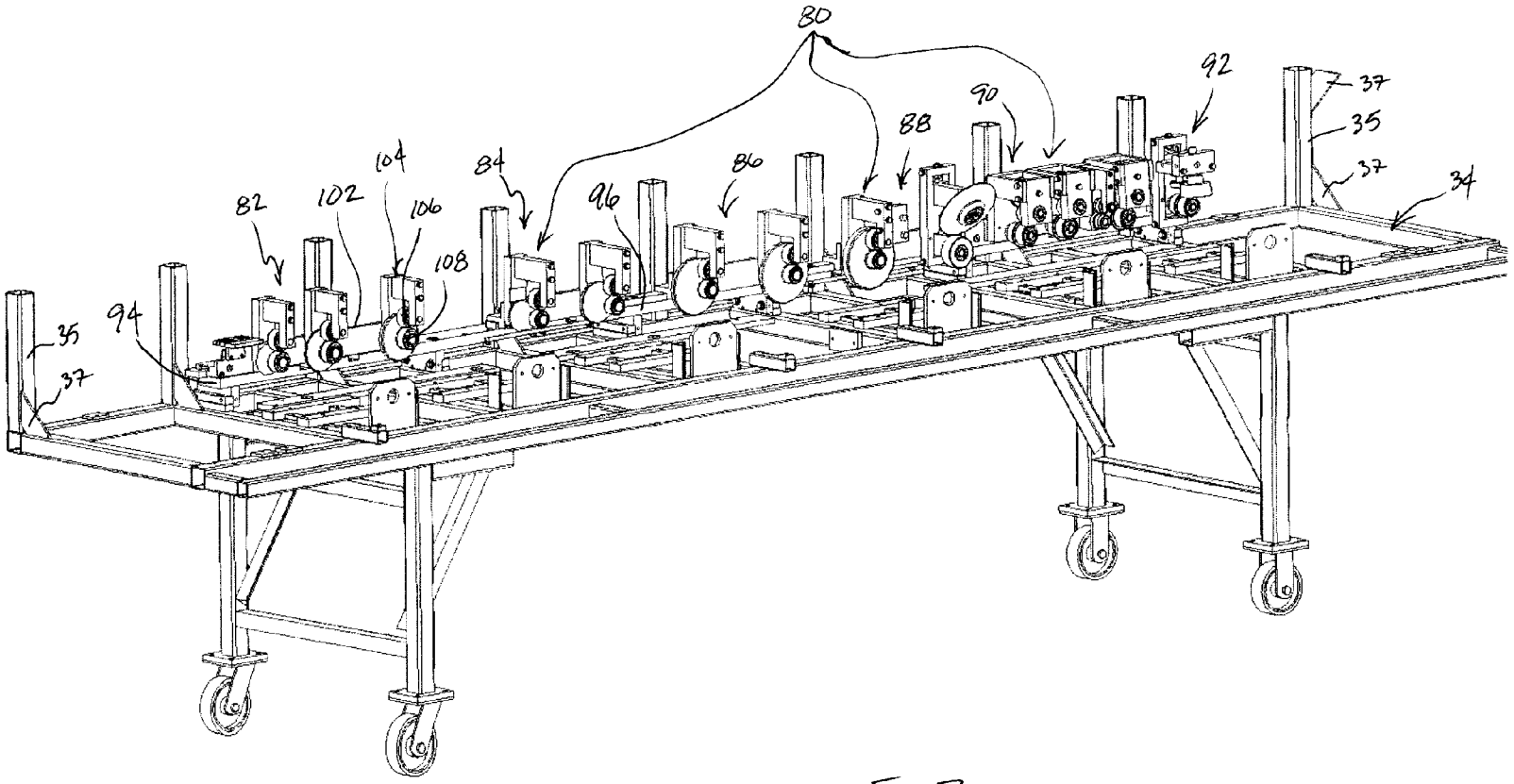
FIG. 7 is a perspective view illustrating the tooling assembly of the roll forming machine shown in FIG. 3 with the drive assembly and support rail assembly removed for clarity.

As the sheet material is advanced through forming machine 10 by drive mechanism assembly 50, tooling assembly 80, as shown in FIG. 6, engages the longitudinal margin 2 of strip 7 to progressively form the margin into the desired profile. Tooling assembly 80 includes a plurality of tooling sets 82, 84, 86, 88, 90, and 92. Tooling set 82 is mounted to tooling rail 94 and tooling sets 84, 86, 88, 90, and 92 are mounted to tooling rail 96. Representative tooling set 82 is perhaps best shown in FIG. 7 and includes a tooling rail segment 102 and a plurality of forming stations supported thereon. Representative forming station 104 includes a pair of freewheeling forming elements 106 and 108 supported relative to each other such that they contribute to progressively forming the desired profile in cooperation with the forming elements of tooling sets 84, 86, 88, 90, and 92. A representative tooling assembly including mounting rails and forming elements is described in co-pending U.S. patent application Ser. No. 12/547,710, filed Aug. 26, 2009, entitled MATERIAL FORMING MACHINE INCORPORATING QUICK CHANGEOVER ASSEMBLY, the disclosure of which is hereby incorporated by reference in its entirety. New Tech Machinery Corp. of Denver, Colo. is the assignee of both the Ser. No. 12/547,710 application and the present application.

It should be noted that while the roll forming machine 10 is shown in the figures with a particular exemplary tooling assembly 80, the forming machine 10 is adapted to accommodate various tooling assemblies for forming corresponding profiles. In particular, forming machine 10 is adapted to accommodate left and right tooling sets from New Tech Machinery Corporation's SSQ, SSH, and SSR lines of forming machines. In other words, the tooling is interchangeable between tapered panel roll forming machine 10 and the SSQ, SSH, and SSR tooling. Accordingly, the tapered panel roll forming machine disclosed herein is an economical companion to the SSQ, SSH, and SSR forming machines that expands the capability of those machines. Forming machine 10 also includes additional mounting pads 141-143, shown in FIG. 6 that may be used to attach additional tooling for storage.

While the construction and operation of the forming machine 10 has been described with respect to a panel being formed by traveling downstream from the entryway 33 to exit 39, the forming machine may be configured to operate in the opposite direction. For example, tooling assembly 80 is left side tooling for forming a male roof panel profile. It should be noted, that the SSQ, SSH, or SSR machines form both left and right side profiles at the same time. Thus, in order for panel 7 to be progressively formed it travels from entryway 33 to exit 39 with the tooling located on the left side of the direction of travel. In contrast, the roll forming machine could be configured with right side, or female tooling. In this case the panel must be advanced through the forming machine in the opposite direction since the right side tooling is installed in the roll forming machine in reverse relative to its location in the corresponding SSQ, SSH, or SSR machine. Thus, panel 7 is progressively formed with the tooling located on the right side with respect to the direction of travel.

Figure 8:
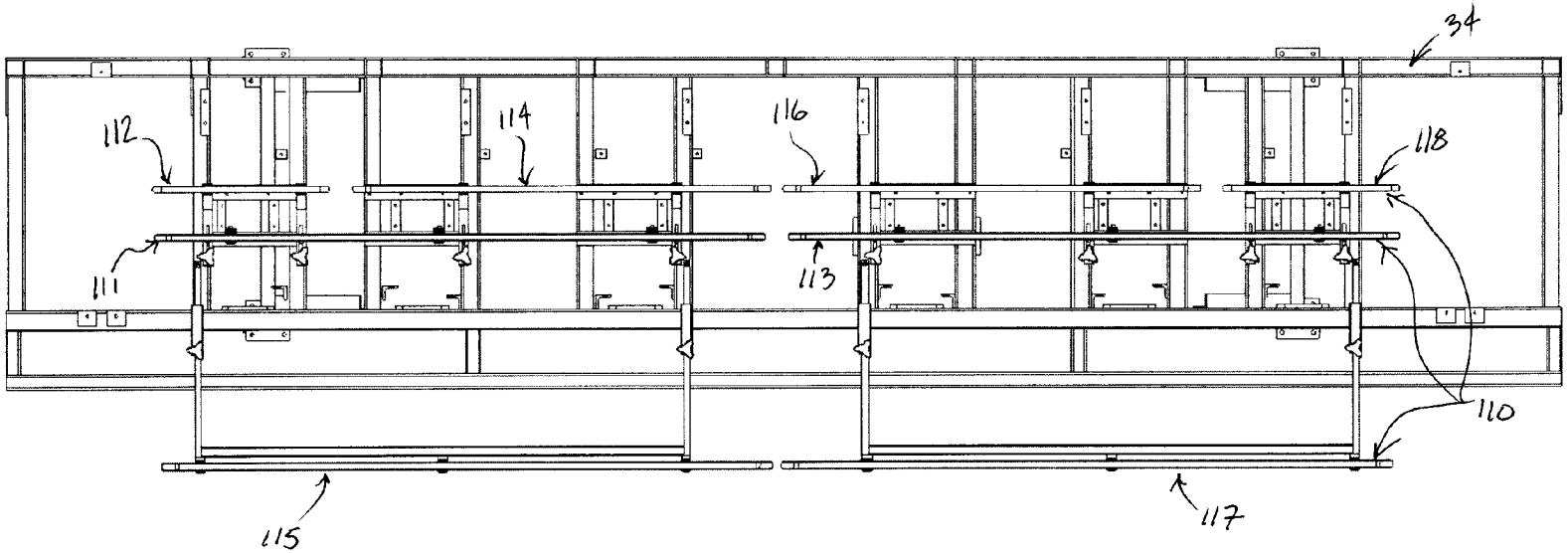
FIG. 8 is top plan view illustrating the support rail assembly of the roll forming machine shown in FIG. 3 with the drive assembly and tooling assembly removed for clarity.
Figure 9:
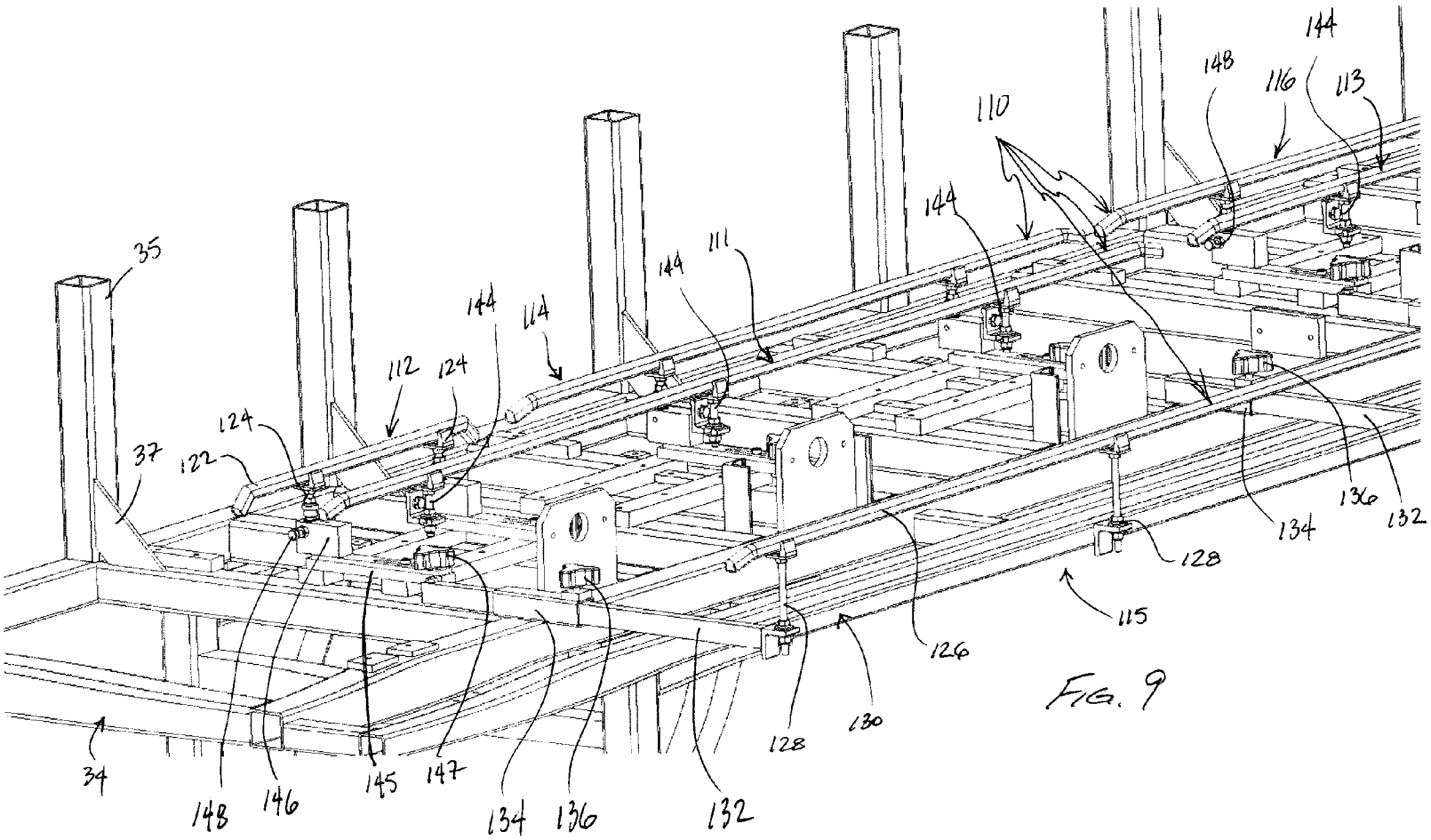
FIG. 9 is an enlarged partial perspective view of the support rail assembly shown in FIG. 8.

Roll forming machine 10 includes support rail assembly 110, shown in FIG. 8. The support rail assembly 110 includes a plurality of support rails 111-118 that are operative to support the strip 7 above the lower frame portion 34 as the strip is advanced through the forming machine. Inboard support rails 112, 114, 116, and 118 are supported by a plurality of stanchions 124. With reference to representative inboard support rail 112, each stanchion 124 engages a detent block 146 whereby the rail 112 may be positioned at a selected height. Spring loaded detent pins 148 are pulled away from the detent block to disengage the associated stanchion 124 so that the height of the rail may be adjusted. Each detent block 146 is mounted to a slotted slide mount 145 whereby the inboard support rails may be adjusted transversely with respect to the downstream direction. Adjustment knobs 147 are loosened and tightened as necessary to facilitate adjustment of slide mounts 145. Intermediate support rails 111 and 113 are supported by stanchions 144 which are mounted to a corresponding one of drive stations 51-56 (see FIG. 10). Outboard support rails 115 and 117 are mounted via stanchions 128 to an associated outrigger frame. For example, representative outboard support rail 115 is supported on outrigger frame 130 that includes a pair of extension arms 132. A pair of receivers 134 are mounted to frame portion 34 that are each sized and adapted to receive a corresponding arm 132. Adjustment knobs 136 are loosened and tightened as necessary to facilitate adjustment of outrigger frame 130.

Figure 10:
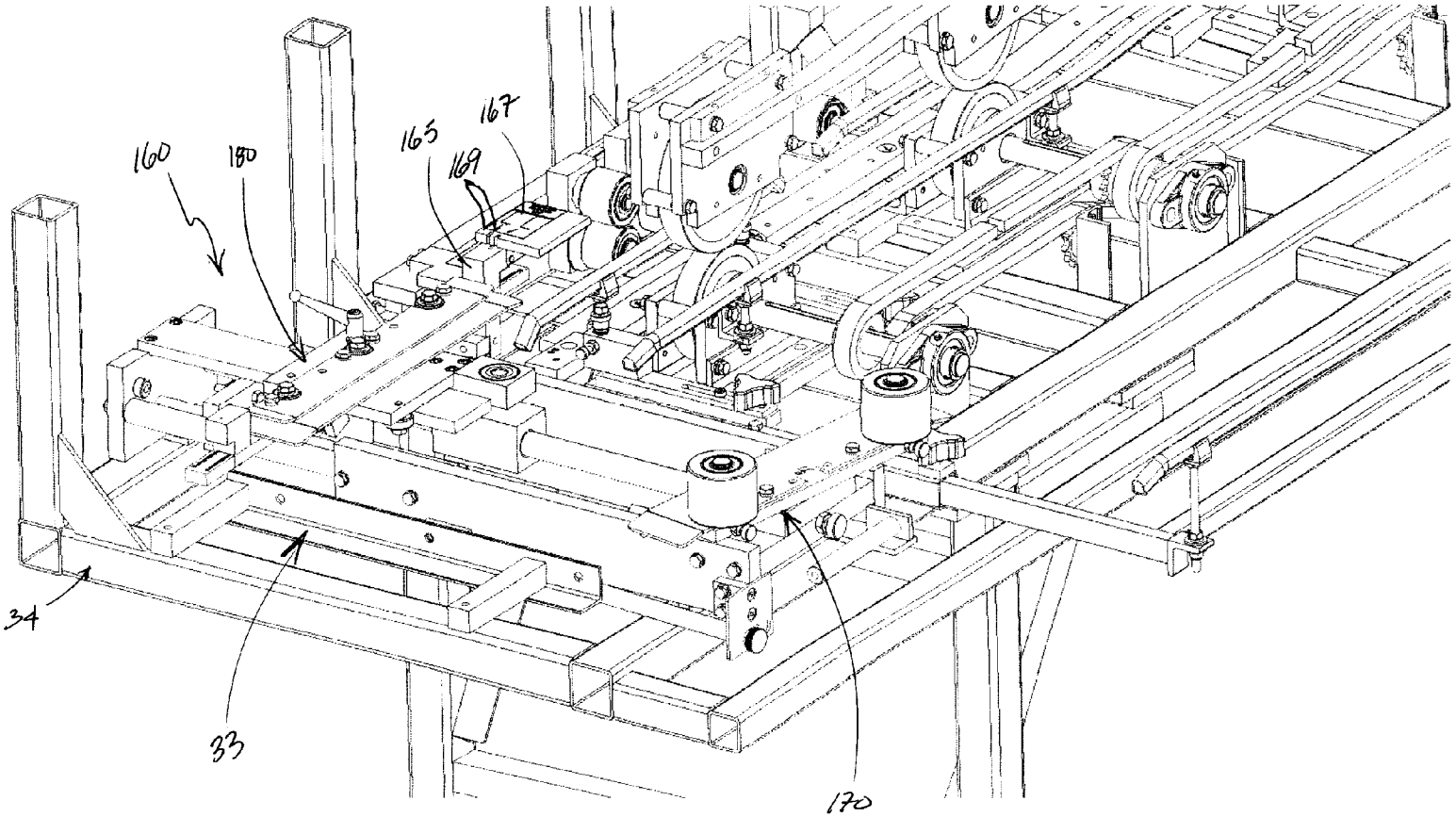
FIG. 10 is an enlarged partial perspective view of the edge guide mechanism mounted to the frame and configured as an entry guide.

FIG. 10 illustrates edge guide mechanism 160, also referred to as a guide roller station, mounted to frame assembly 34 near the entryway 33 of roll forming machine 10. Edge guide mechanism 160 includes stationary edge guide 180 and pivoting edge guide 170. Stationary edge guide 180 is configured to receive a flat unformed edge margin of sheet material. Pivoting edge guide 170 is, in this case, configured to receive the formed edge margin of a panel. Also shown in FIG. 10 is legend plate 167 which identifies two different leg configurations as indicated by notches 169. An indicator 165 located on stationary edge guide 180 is aligned with one of the two notches 169 to select the desired leg configuration.

Figure 11:
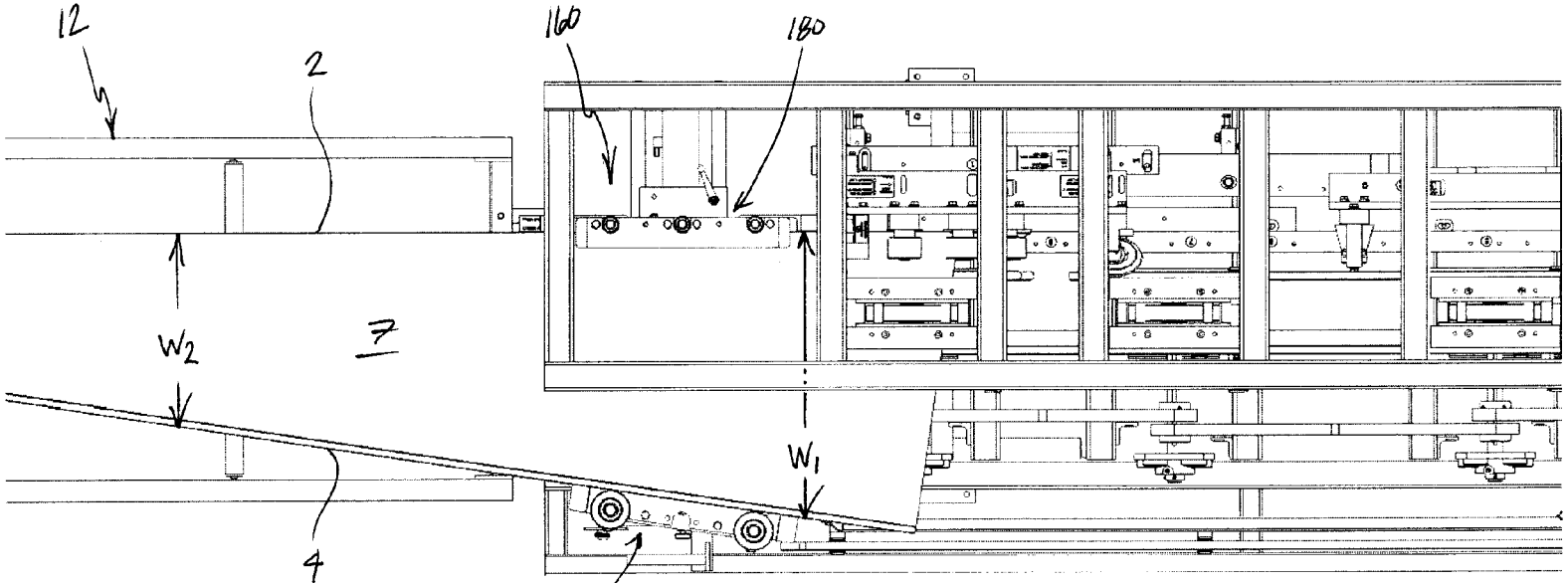
FIG. 11 is a partial top plan view of a representative tapered panel being guided into the roll forming machine by the edge guide mechanism.
Figure 12:
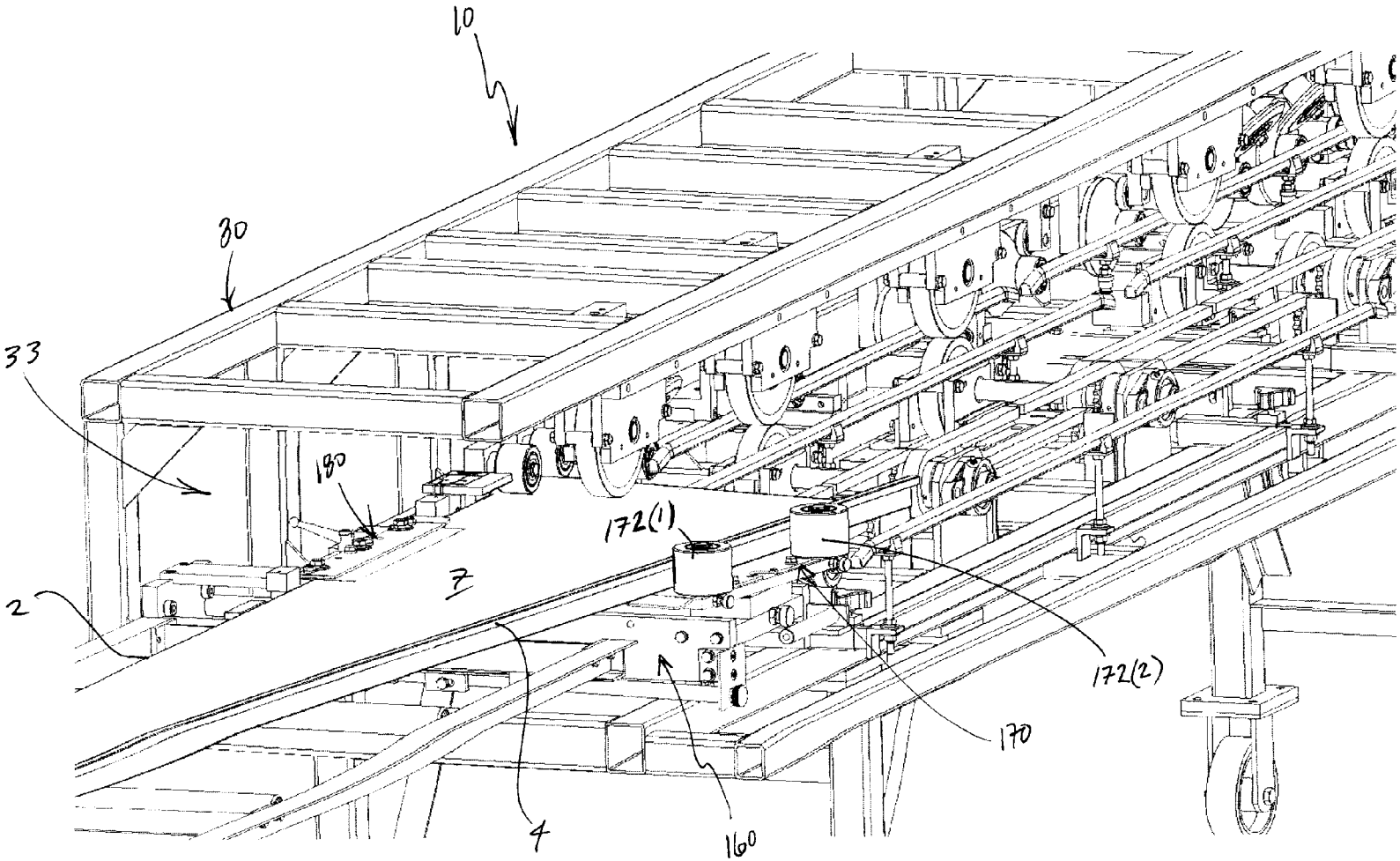
FIG. 12 is a partial perspective view, similar to FIG. 11, of the panel entering the roll forming machine.

FIG. 11 illustrates tapered panel 7 as it is advanced into roll forming machine 10 and guided by edge guide mechanism 160. As can be seen in the figure, panel 7 is received in the stationary edge guide 180 along longitudinal edge margin 2. Edge guide 170 is adapted to receive formed edge margin 4 of the strip. With further reference to FIG. 12, it can be appreciated that guide rollers 172(1) and 172(2) receive the formed edge margin 4 of panel 7 as the panel enters the forming machine 10. While the guide rollers 172(1) and 172(2) are shown here as cylindrical, the guide rollers may, however, have various profiles to match the particular profile of the edge margin 4 depending on the leg configuration. An edge margin is received by an edge guide in that the edge guide engages, accommodates, confronts, matches, mates with, or captures the edge margin.

Panel 7 is a tapered strip of material that tapers from a first width $W_1$ to a second width $W_2$. Edge guide mechanism 160 receives edge margin 4 of the strip that is opposite the longitudinal margin 2 and applies pressure along the edge margin 4 in a lateral direction, thereby following the edge margin 4 as the strip is advanced through the forming region. Accordingly, edge guide 170 is movable (i.e. floating) such that a distance between the guide rollers 172(1) and 172(2) and the stationary edge guide 180 varies between width $W_1$ and width $W_2$. Although, the panel in the figures is advancing through the forming machine large end (in this case $W_1$) first, panels may also be fed into the machine's narrow end first as appropriate.

Figure 13:
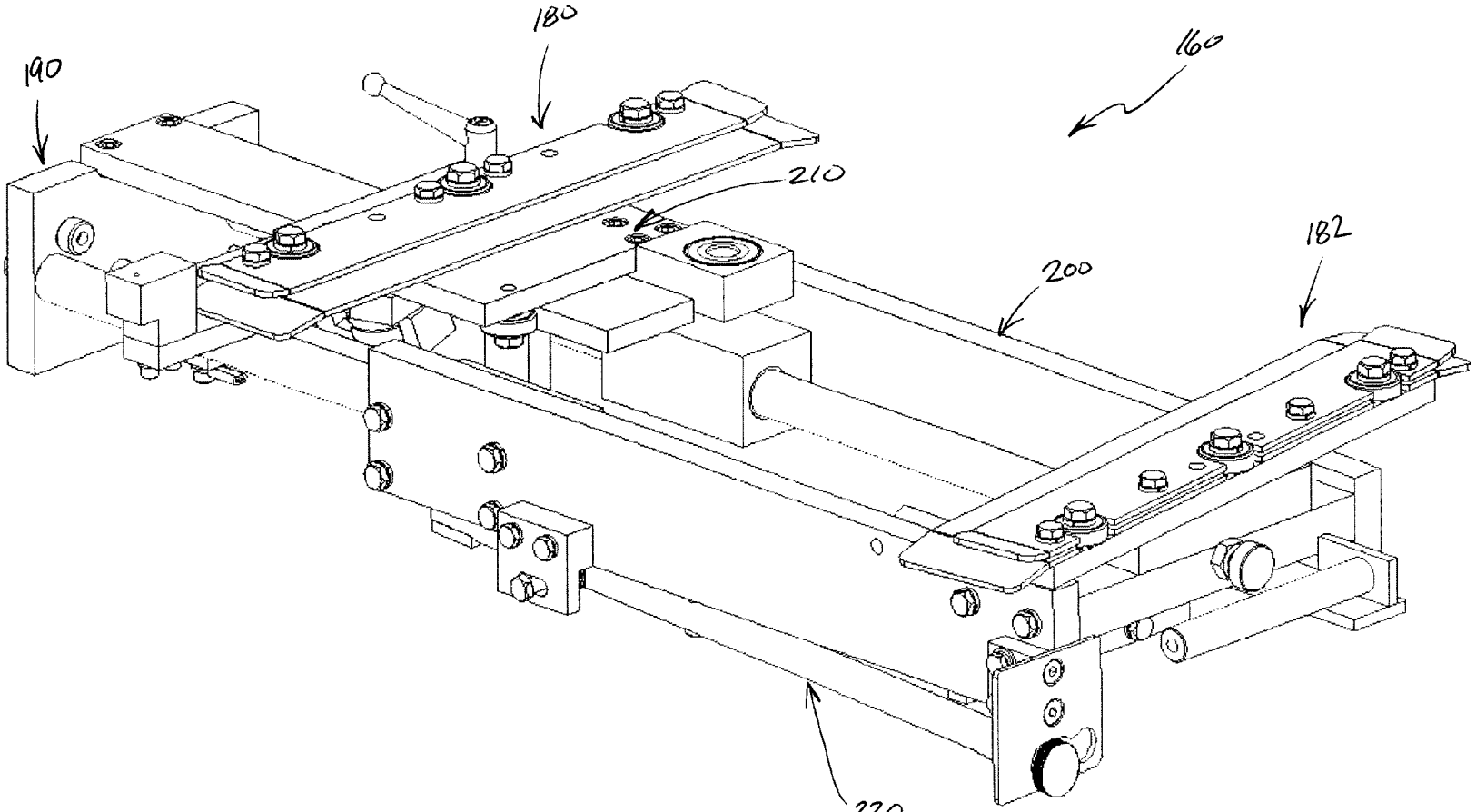
FIG. 13 is an enlarged perspective view of an edge guide mechanism assembly configured to receive an unformed panel.
Figure 14:
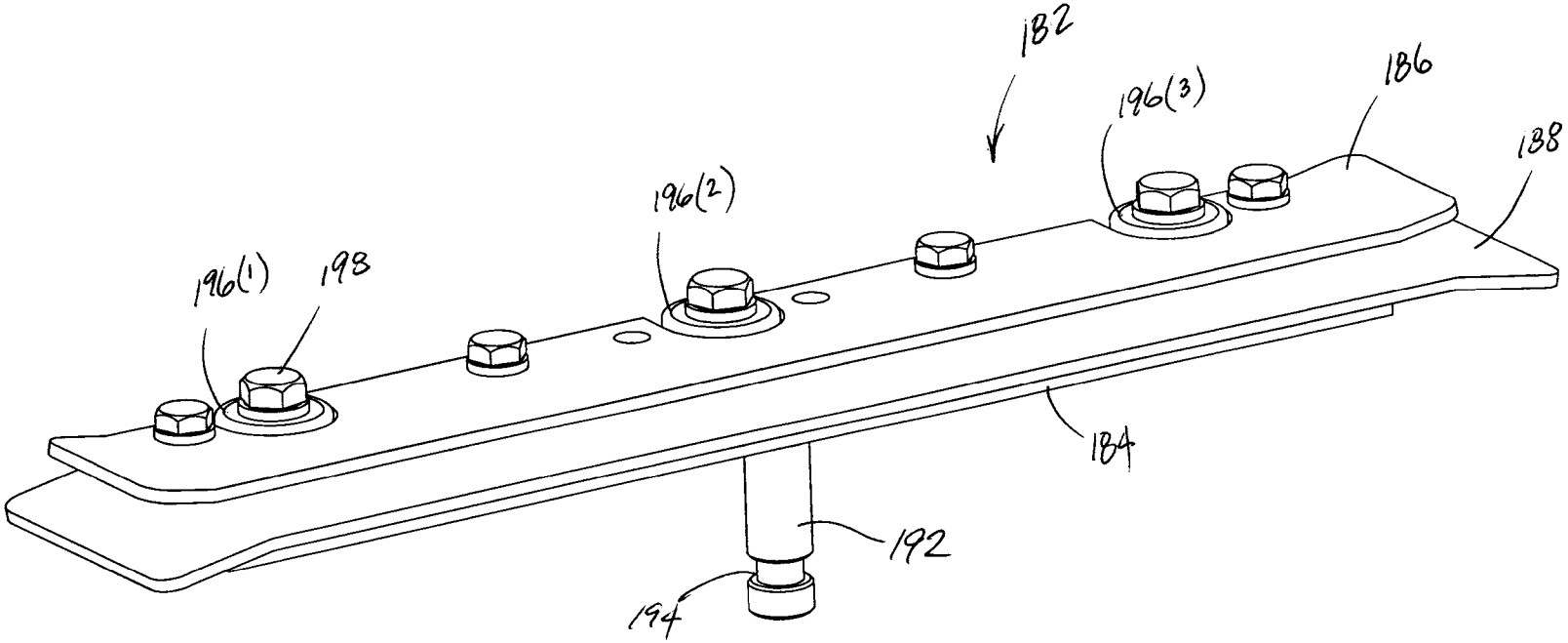
FIG. 14 is a perspective view of the edge guide shown in FIG. 13.

As shown in FIG. 13, edge guide mechanism 160 may be configured to receive a panel which has flat, or unformed, edges on both sides of its width. In this case, edge guide 170 has been replaced with edge guide 182. Edge guide 182 is configured to receive a flat edge margin of a tapered panel. Edge guide 182 has a similar construction to that of stationary edge guide 180. Referring to FIG. 14, edge guide 182 includes a pivot pin 192 including a groove or notch 194 formed thereon. Edge guide 182 also includes a base plate 184 to which a pair of guide plates 186 and 188 are attached. Upper guide plate 186 and lower guide plate 188 are spaced apart by a shims or washers (not shown). The guide plates 186 and 188 are attached to base plate 184 with a plurality of fasteners, such as representative cap screw 198. Edge guide 182 also includes a plurality of bearings 196(1)-196(3) situated as shown with respect to the guide plates. The bearings provide a low friction, rolling surface against which the edge of the sheet material may travel. The bearings are also attached to the base plate 184 by fasteners, such as representative cap screw 198.

Figure 15:
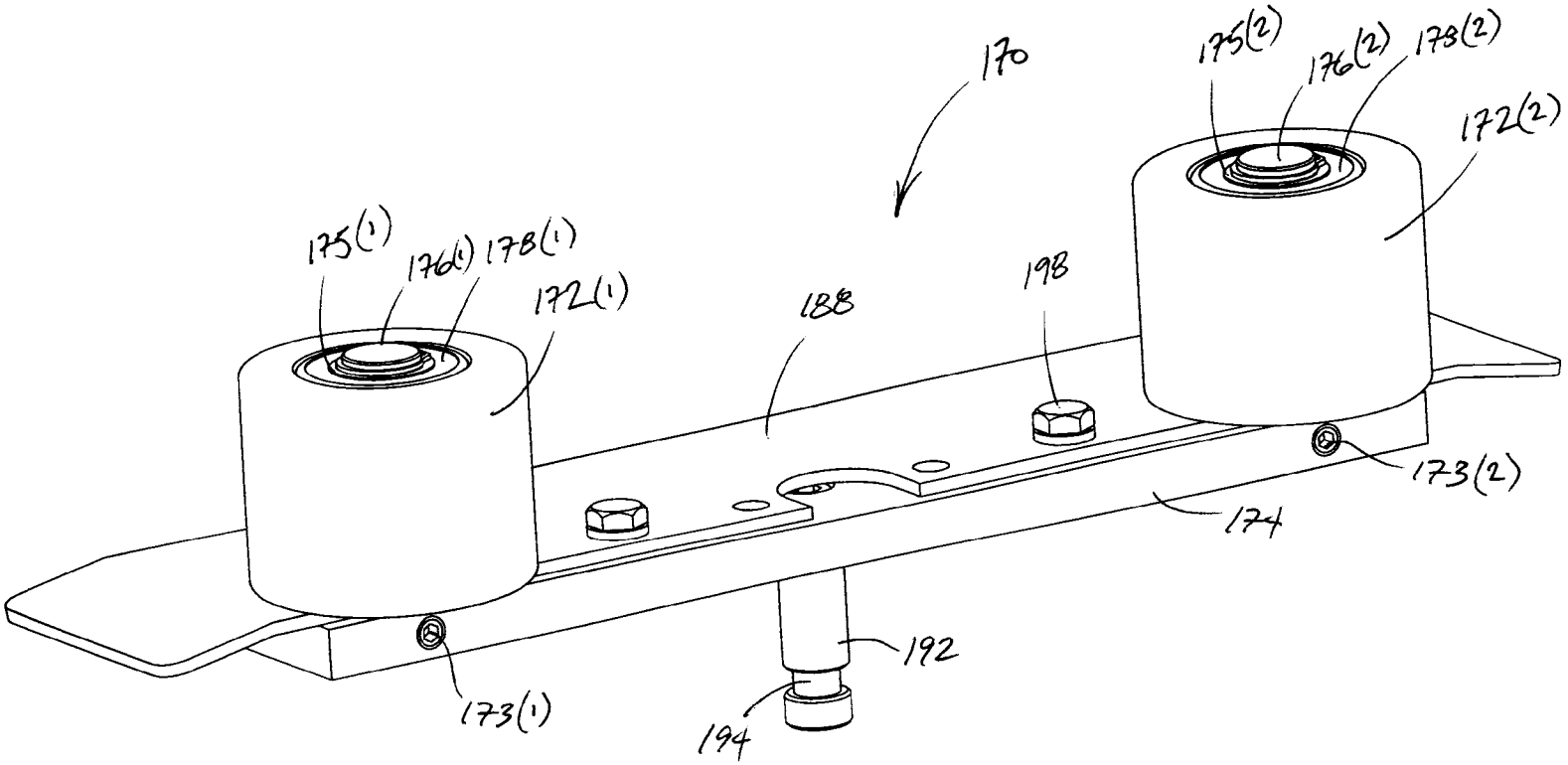
FIG. 15 is a perspective view of the edge guide shown in FIGS. 10-12.

FIG. 15 illustrates edge guide 170 which is configured to accommodate a formed profile on an edge margin of the tapered panel. Edge guide 170 includes a base plate 174, also referred to as a guide bar, which receives a pair of roller pins 176(1) and 176(2). Rotatably disposed on each roller pin is a roller 172(1) and 172(2), respectively. Each roller includes a pair of bearings 178(1) and 178(2) and is retained on pin 176 by a snap ring 175. Lower guide plate 188 supports the edge of the panel as it moves past the rollers 172(1) and 172(2). Lower guide plate 188 is attached to base plate 174 with fasteners, such as representative fastener 198. Roller pins 176(1) and 176(2) are secured in base plate 174 with set screws 173(1) and 173(2). Also, as explained with respect to edge guide 182, the edge guide 170 includes a pivot pin 192. It should be noted that several of the parts for edge guide 170 and edge guide 182 are interchangeable. For example, pivot pin 192, lower guide plate 188, and fasteners 198 may be used on either guide.

Figure 16:
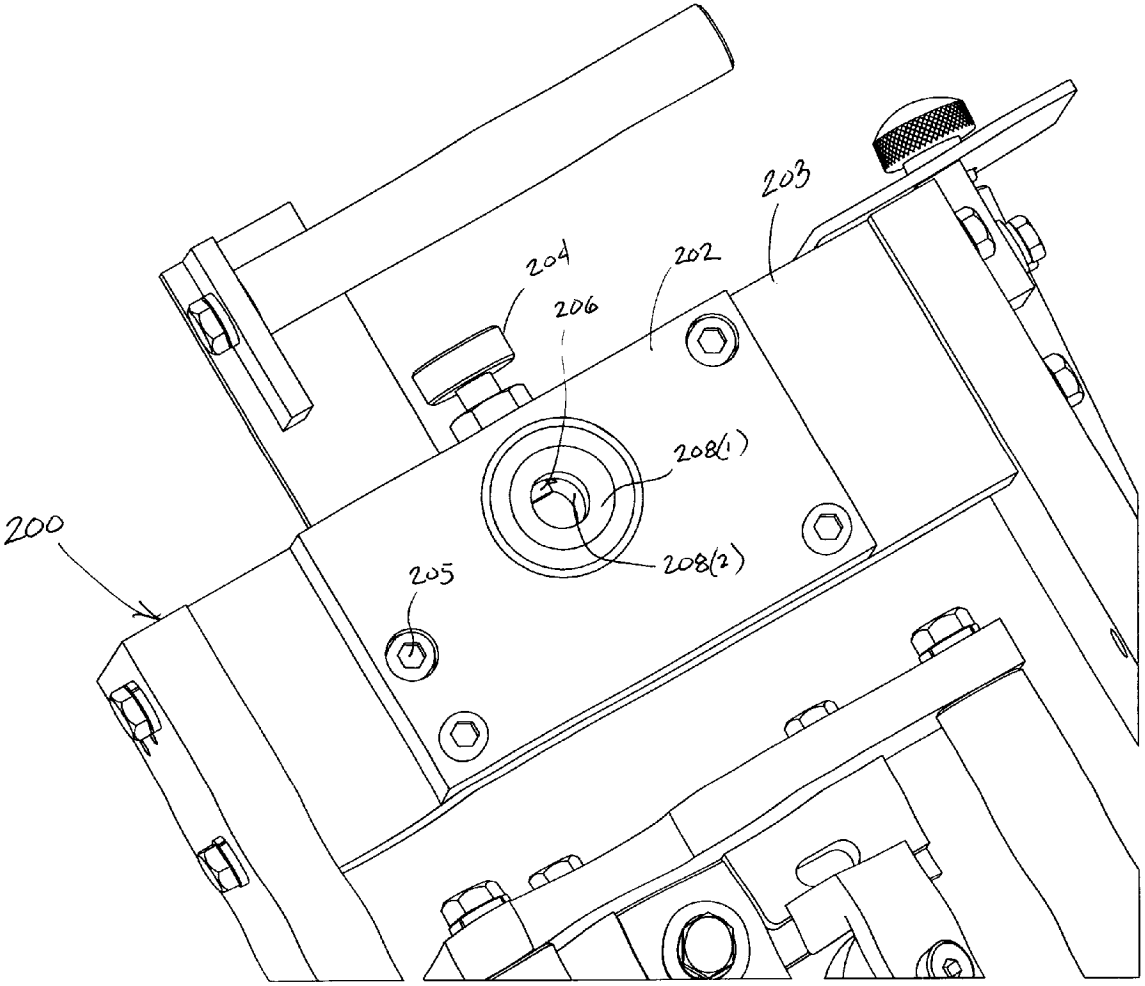
FIG. 16 is an enlarged partial perspective view of the edge guide receiver.

FIG. 16 illustrates an edge guide receiver which is included on floating carriage 200. The receiver comprises a pair of bearings 208(1) and 208(2) that are pressed into receiver plate 202. Receiver plate 202 is attached to carriage cross member 203 with a plurality of fasteners, such as representative socket head cap screw 205. The inner diameter of bearings 208 are sized to receive pivot pin 192 shown in FIGS. 14 and 15 with respect to edge guides 170 and 182. A detent 204, which is spring loaded, engages groove 194 formed on pivot pins 192. Detent 204 includes a detent pin 206 which engages groove 194. The pivoting edge guides are therefore able to pivot in bearings 208(1) and 208(2) in order to follow the tapered angle of the panel traveling through the machine. Detent 204 allows the edge guide mechanism 160 to be efficiently reconfigured to accommodate different edge profiles (or flat edge margins) by changing between edge guides 170 and 182, for example.

Figure 17:
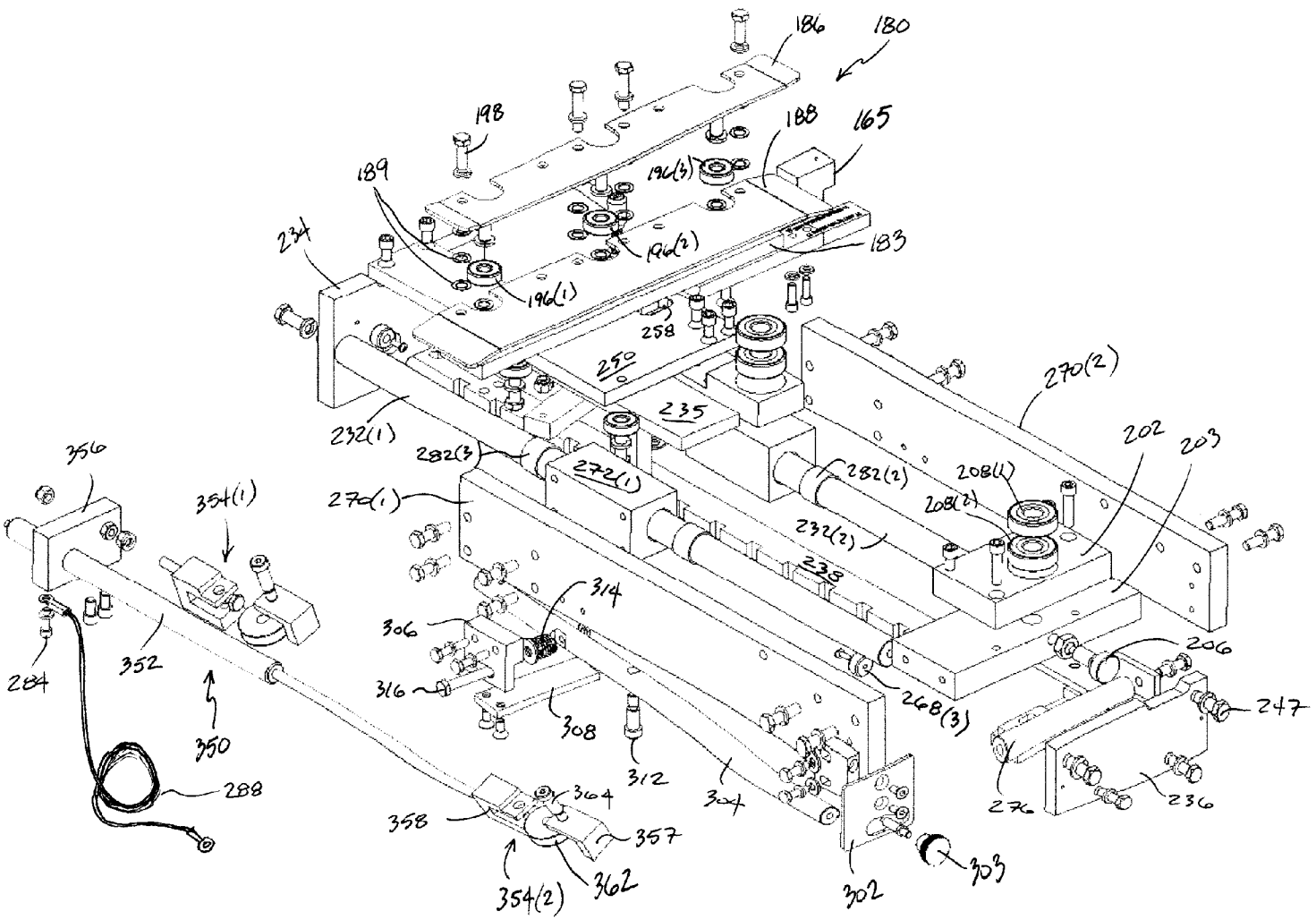
FIG. 17 is a partial exploded view of the edge guide mechanism.

It may be helpful to refer to FIG. 17 as the edge guide mechanism and its various subassemblies are described more fully below. Also, the assembly of stationary edge guide 180 is perhaps best shown in FIG. 17. Stationary edge guide 180 includes base plate 183 that attaches to adjustment slide plate 250. The construction of stationary guide 180 is similar to that of edge guide 182. Lower guide plate 188 and upper guide plate 186 are spaced apart by a plurality of shims or washers, such as representative shims 189. The guide plates 186 and 188 are attached to base plate 183 with a plurality of fasteners, such as cap screw 198. Edge guide 180 also includes a plurality of bearings 196(1)-196(3) situated as shown with respect to the guide plates. The bearings provide a low friction, rolling surface against which the edge of the sheet material may travel.

Figure 18:
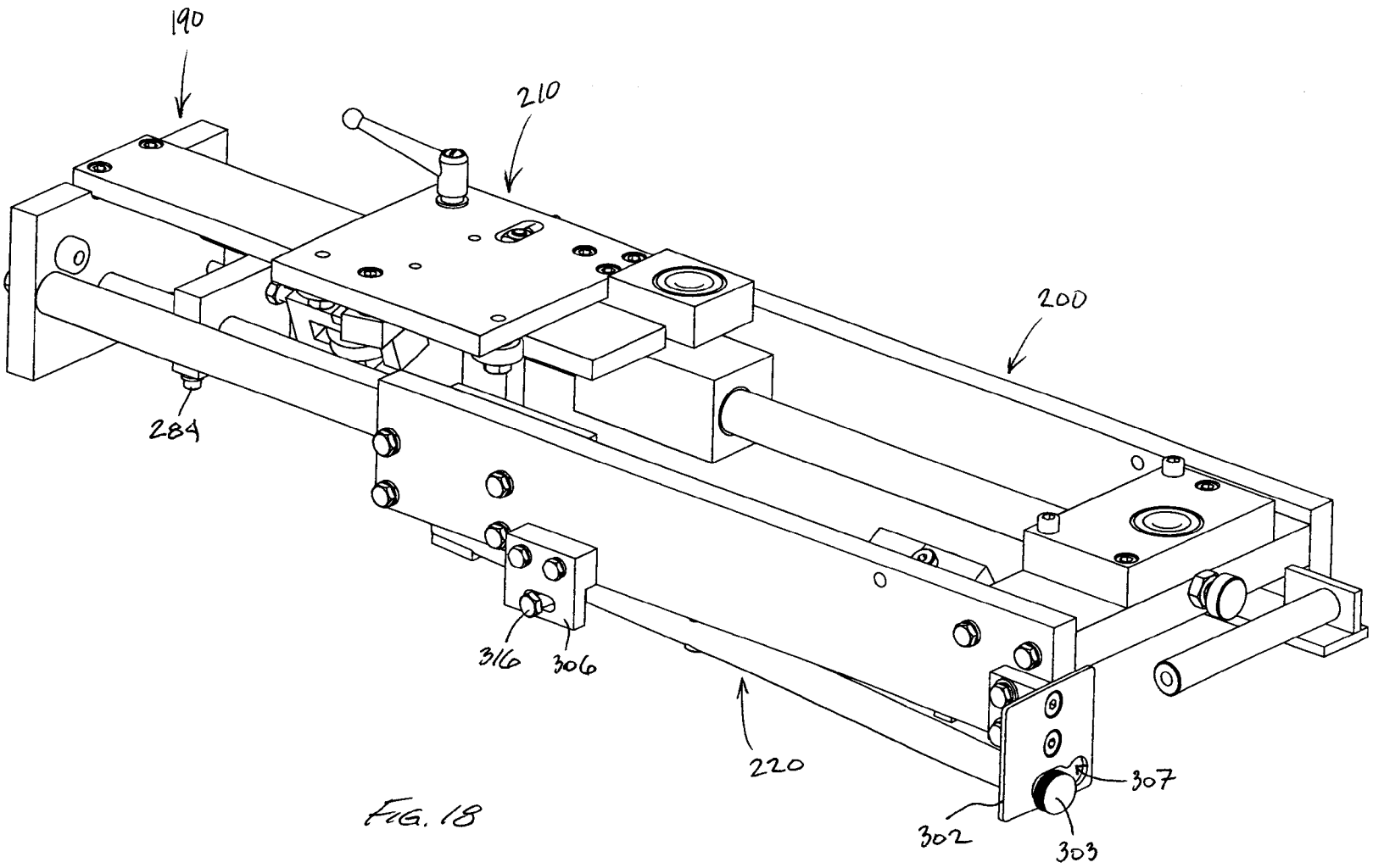
FIG. 18 is a perspective view of the edge guide mechanism with the stationary edge guide and the floating edge guide removed for clarity.
Figure 19:
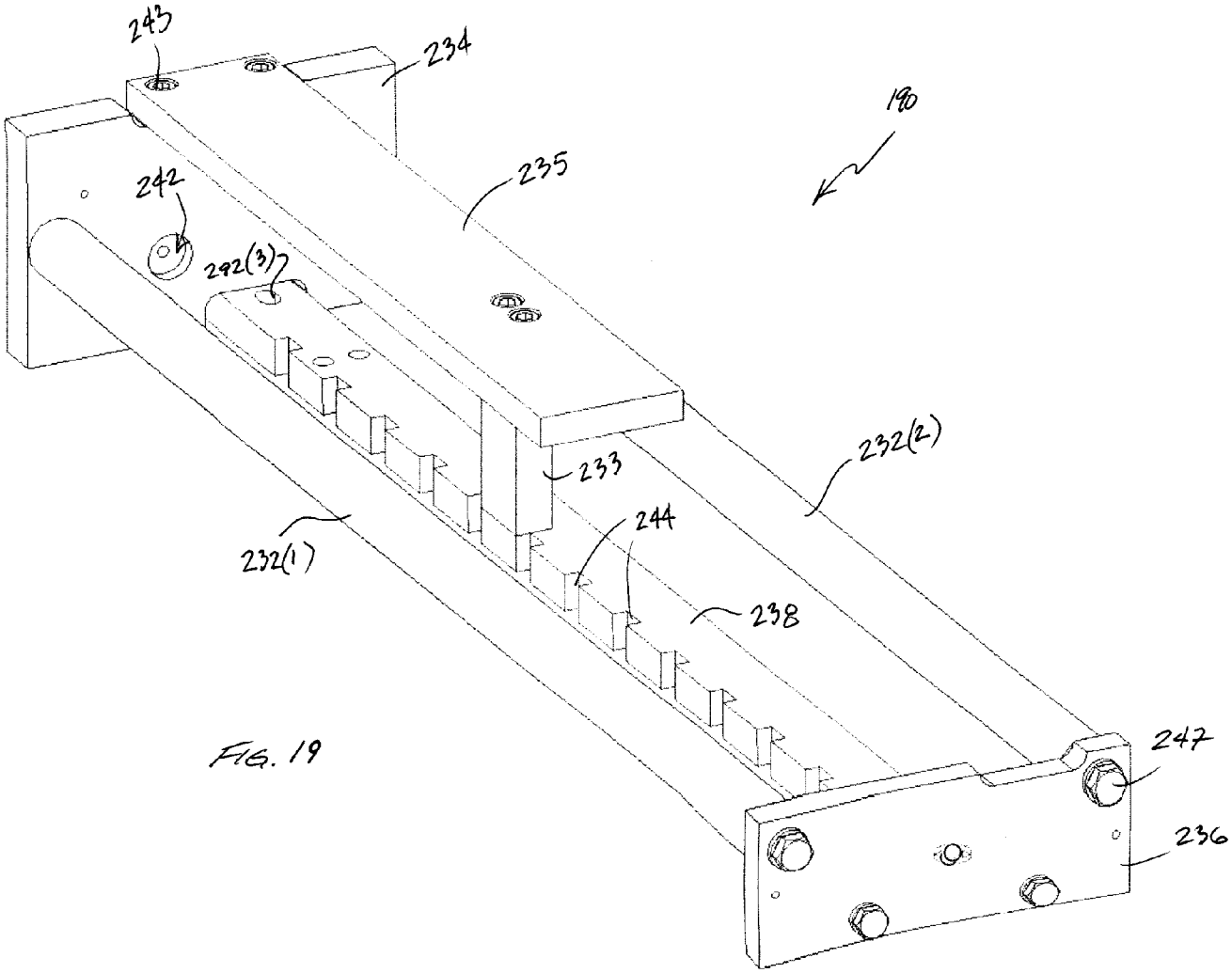
FIG. 19 is a perspective view of the carriage frame.

As shown in FIG. 18, edge guide mechanism 160 includes carriage frame 190, floating carriage 200, stationary guide adjustment slide 210, and latch assembly 220. With further reference to FIG. 19, carriage frame 190 includes end plates 234 and 236 between which a pair of bearing rods 232(1) and 232(2) extend. Bearing rods 232(1) and 232(2) are secured to the end plates 234 and 236 with a plurality of fasteners, such as representative hex cap screw 247. Also extending between end plates 234 and 236 is a ratchet bar 238 which includes a plurality of notches 244. Carriage frame 190 also includes a slide rail 235 attached at one end to end plate 234 and supported on the opposite end by stanchion 233. Slide rail 235 is attached to the stanchion and end plate with a plurality of fasteners, such as representative socket head cap screw 243. Carriage frame 190 includes a plurality of bumpers 268(1)-268(4) disposed on the end plates to cushion carriage 200 from impacting the end plates (see FIGS. 17 and 20).

Figure 20:
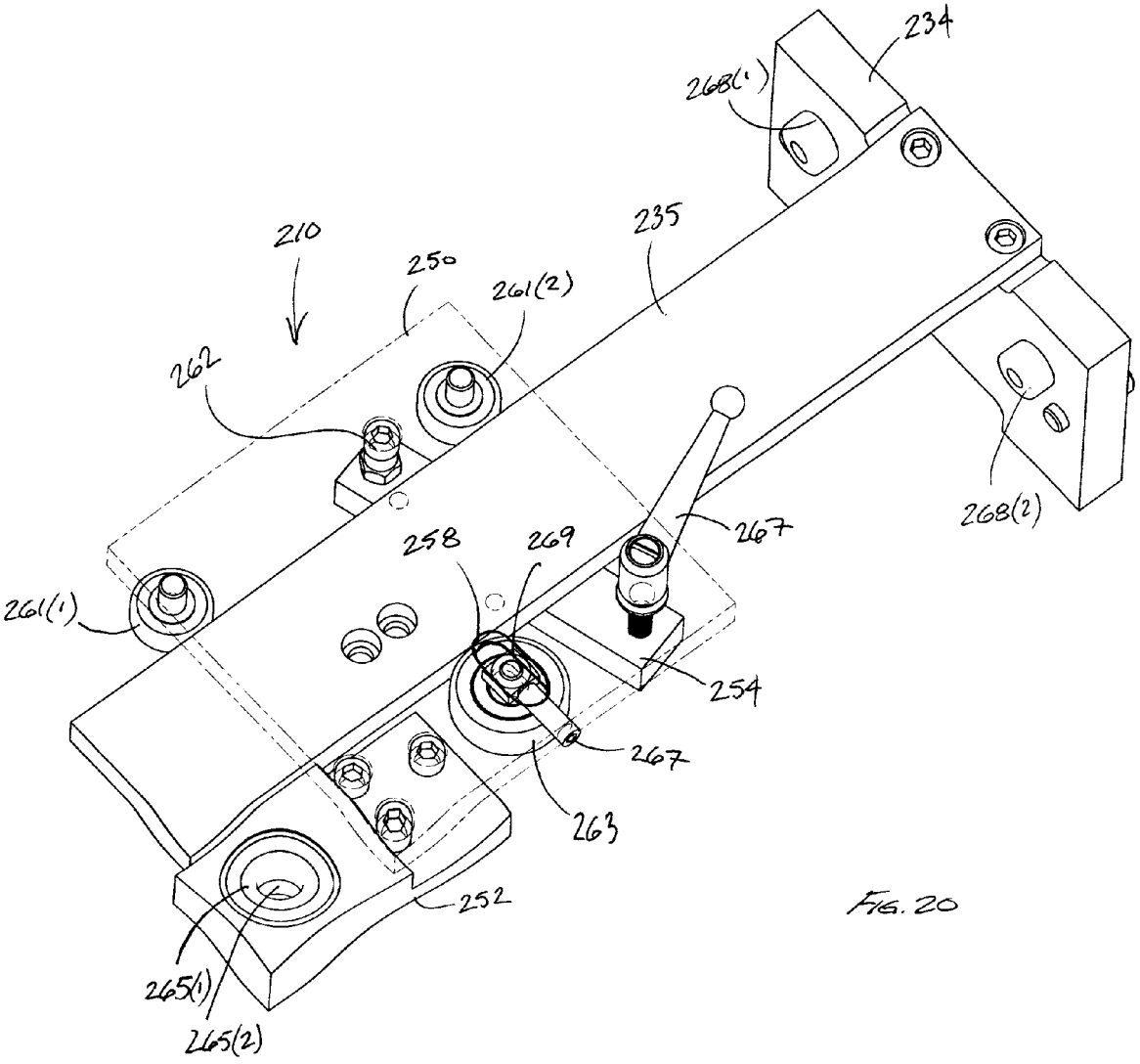
FIG. 20 is a partially transparent perspective view of the stationary edge guide adjustment slide as viewed from the top.
Figure 21:
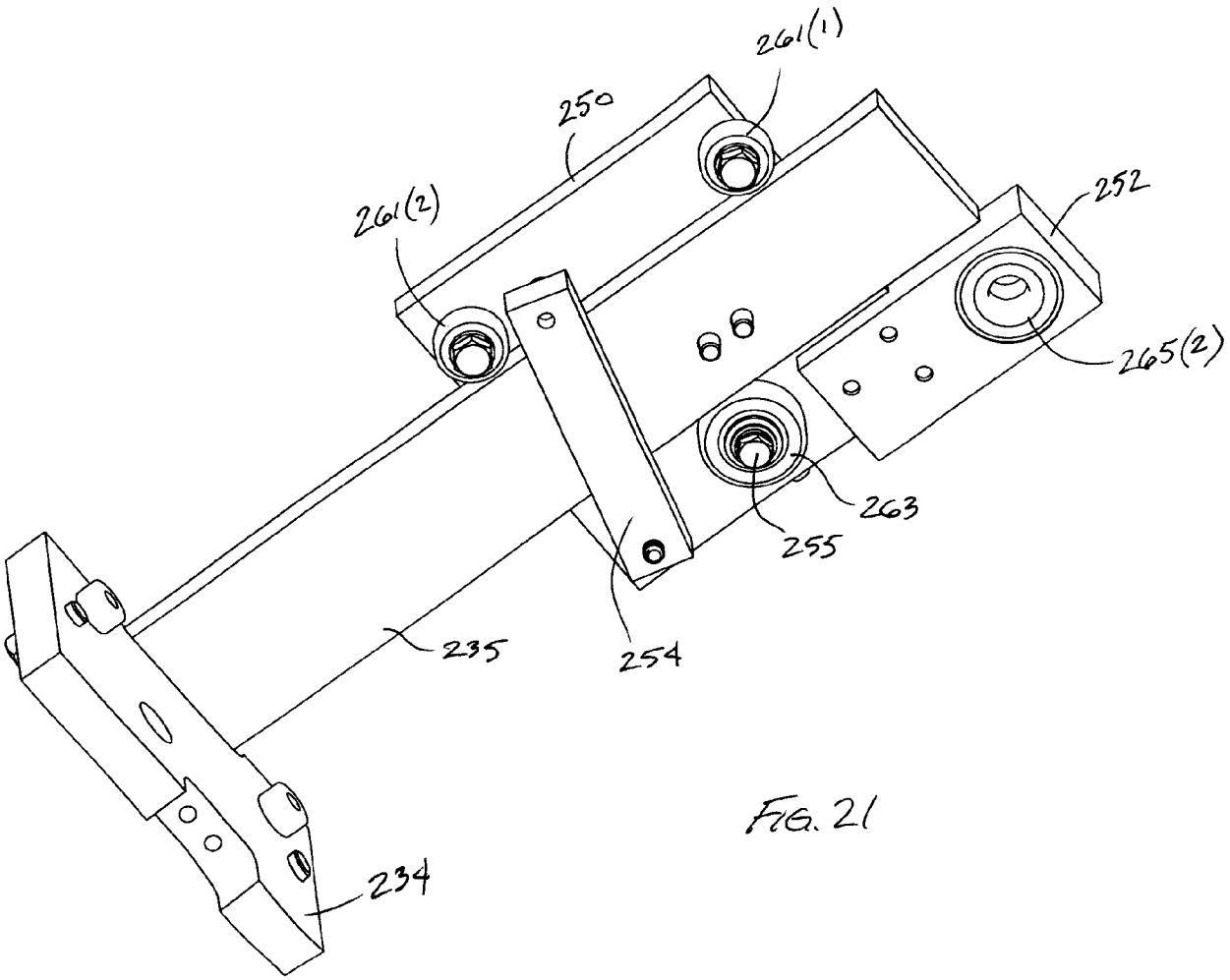
FIG. 21 is an underside perspective view of the adjustment slide shown in FIG. 20.

FIGS. 20 and 21 illustrate the stationary edge guide slide assembly 210 which is used to adjust the location of the stationary edge guide 180 with respect to the tooling assembly 80 in order to locate, or position, the edge margin relative to the tooling sets. Slide assembly 210 includes adjustment slide plate 250 which is adjusted along slide rail 235. It should be noted that slide plate 250 is shown as being transparent in FIG. 20 to facilitate explanation of the assembly. Slide plate 250 is captured on slide rail 235 by guide bearings 261(1), 261(2), and 263. Guide bearing 263 is adjustable with respect to the width of slide rail 235. Guide bearing 263 is attached to slide plate 250 in a slot 258 which contains a square nut 269. Square nut 269 moves back and forth in countersunk slot 258, thereby allowing adjustment of guide bearing 263 by tightening set screw 267. With reference to FIG. 21, it can be appreciated that guide bearing 263 is fastened to slide nut 269 with fastener 255. Thus, in order to adjust guide bearing 263, fastener 255 is loosened prior to adjusting set screw 267 and retightened thereafter.

The position of slide assembly 210 may be selectively adjusted along slide rail 235 and locked into place. The slide assembly 210 is locked in position by lock bar 254. Lock bar 254 is attached to slide plate 250 on one end by fastener 262 and on the other by locking arm 267 which extends through slide plate 250 and is threaded into lock bar 254. Accordingly, in order to adjust slide assembly 210, lock bar 267 is loosened, whereby the slide plate 250 may be moved along slide rail 235 and thereafter locked into position by tightening locking arm 267, which in turn pulls lock bar 254 against the underside of slide rail 235. Adjustment assembly 210 also includes an exit guide receptacle 252. Exit guide receptacle 252 includes a pair of bearings 265(1) and 265(2) which are pressed into the receptacle 252. Thus, a guide, such as edge guide 170, may be installed into exit guide receptacle 252 for use on the exit end of the forming machine.

Figure 22:
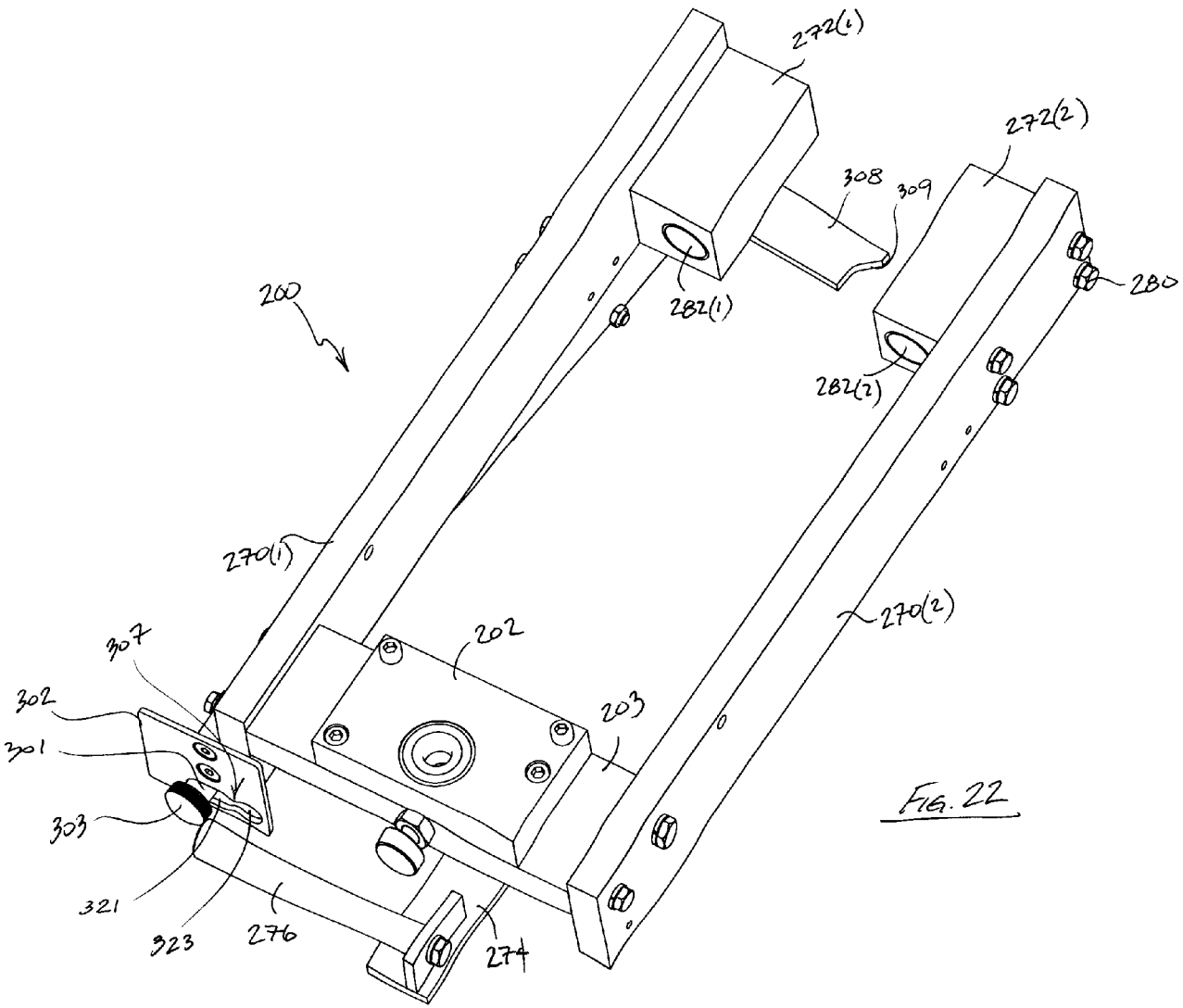
FIG. 22 is a perspective view of the floating edge guide carriage.

FIG. 22 illustrates floating carriage 200 which supports a pivoting edge guide. Carriage 200 includes a pair of side plates 270(1) and 270(2) which are spaced apart by cross member 203. The side rails 270 are attached to cross member 203 with a plurality of fasteners, such as for example, representative hex cap screw 280. Linear bearing blocks 272(1) and 272(2) are attached to side rails 270(1) and 270(2), respectively. Each bearing block 272(1) and 272(2) includes a pair of bushings 282(1) and 282(2). The bushings 282(1) and 282(2) are sized and configured to receive the bearing rails 232(1) and 232(2) as shown in FIG. 19. Accordingly, carriage 200 translates, or floats, back and forth along bearing rails 232(1) and 232(2). A handle 276 is attached via bracket 274 to cross member 203. Handle 276 is useful in initially adjusting the location of carriage 200 with respect to stationary guide 180.

Figure 23:
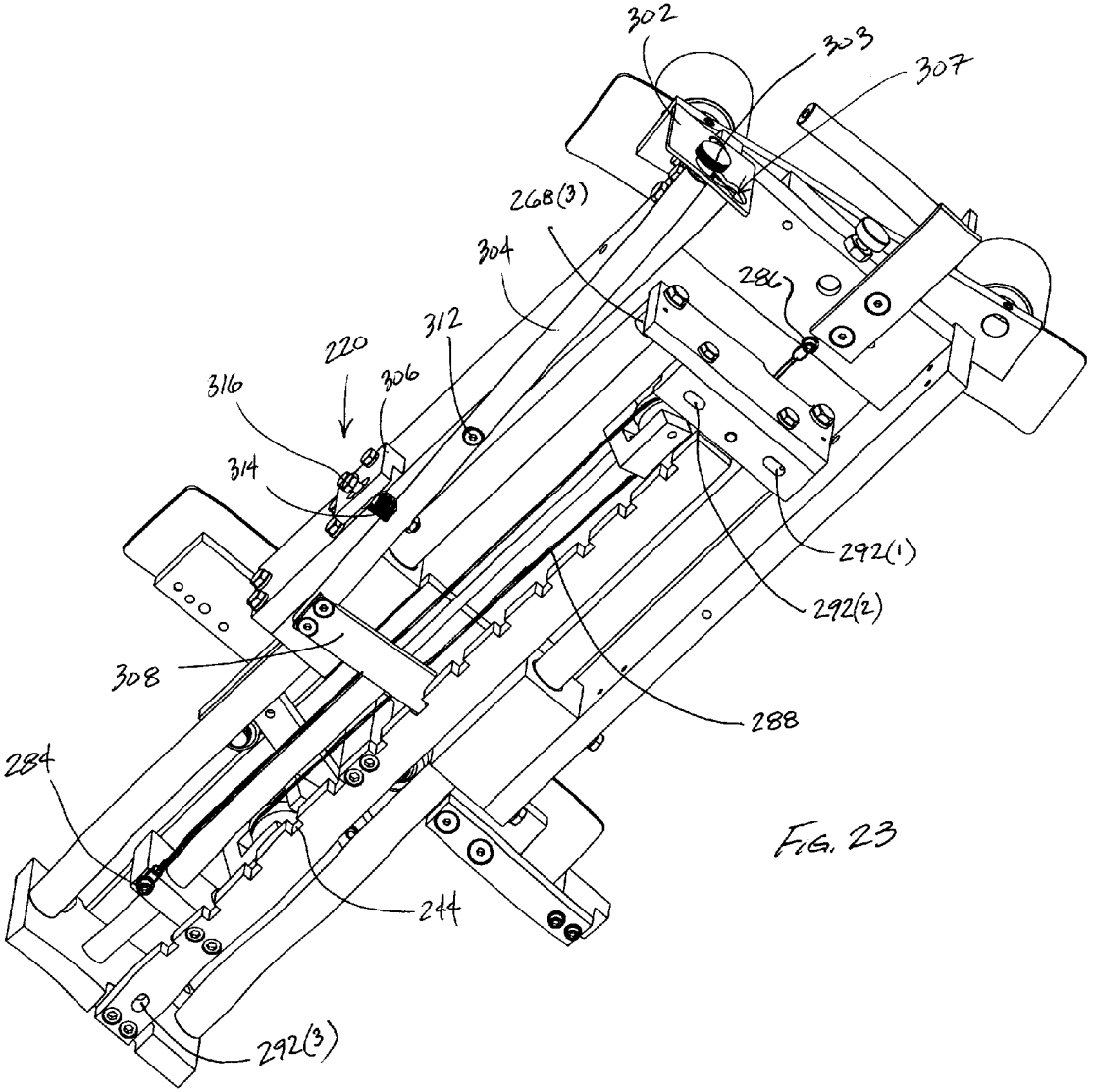
FIG. 23 is an underside perspective view of the edge guide mechanism illustrating the latch mechanism assembly.

FIG. 23 shows edge guide mechanism 160 from underneath, such that the latch mechanism 220 may be better appreciated. Latch mechanism 220 is useful in initially adjusting the position of carriage 200 depending on the width of the tapered panel and whether it is fed in narrow end first or wide end first. By adjusting the initial position of carriage 200, feeding a panel into the machine may be more easily accomplished. Latch mechanism 220 includes a latch pawl 308 which is attached to latch arm 304. Latch pawl 308 engages notches 244 (also see FIG. 19). To initially adjust the position of carriage 200, latch arm 304 is moved about pivot pin 312, thereby disengaging pawl 308 from notches 244. By moving knob 303 to the right the pawl is disengaged from the notches allowing movement of the carriage.

Gate 307 is formed in bracket 302 which supports the end of latch arm 304. Gate 307 includes an elongate portion 321 corresponding to a latched state and a short portion 323 corresponding to an unlatched state. Knob 303 is spring loaded in a longitudinally inward direction with respect to latch arm 304. Accordingly, to move knob 303 from elongate portion 321 of gate 307 (also see FIG. 22) to the short portion 323, knob 303 is first pulled outwardly, thereby disengaging the base 301 of knob 303 from the latch gate 307. Latch mechanism 220 may be retained in the unlatched state such that pawl 308 does not engage any of teeth 244 by moving the latch rod 304 towards the far right of gate 307 and engaging knob 303 in short portion 323. In the unlatched state, carriage 200 may freely move back and forth without the pawl 308 engaging any of the notches.

When in the latch state bias member 314, in this case, a compression spring, biases the latch arm 304 and pawl 308 towards notches 244. With reference to FIG. 22, it can be appreciated that pawl 308 is configured with a ramped surface 309. As the carriage 200 moves in an outboard direction, the edge of each notch confronts the ramp surface 309, thereby lifting pawl 308 and thus urging latch arm 304 against spring 314 such that the pawl 308 disengages the associated notch. The elongate portion 321 of gate 307 allows latch arm 304 to pivot back and forth as pawl 308 ramps out of each notch. Accordingly, the carriage 200 may be moved outwardly while in the latched state either manually or by force of material traveling through the machine. In this state, however, the carriage may not move in an inboard direction as the pawl edge engages notch 244. Spring 314 is retained with bracket 306 and bolt 316 which extends through latch arm 304 as shown in FIG. 23.

Figure 24:
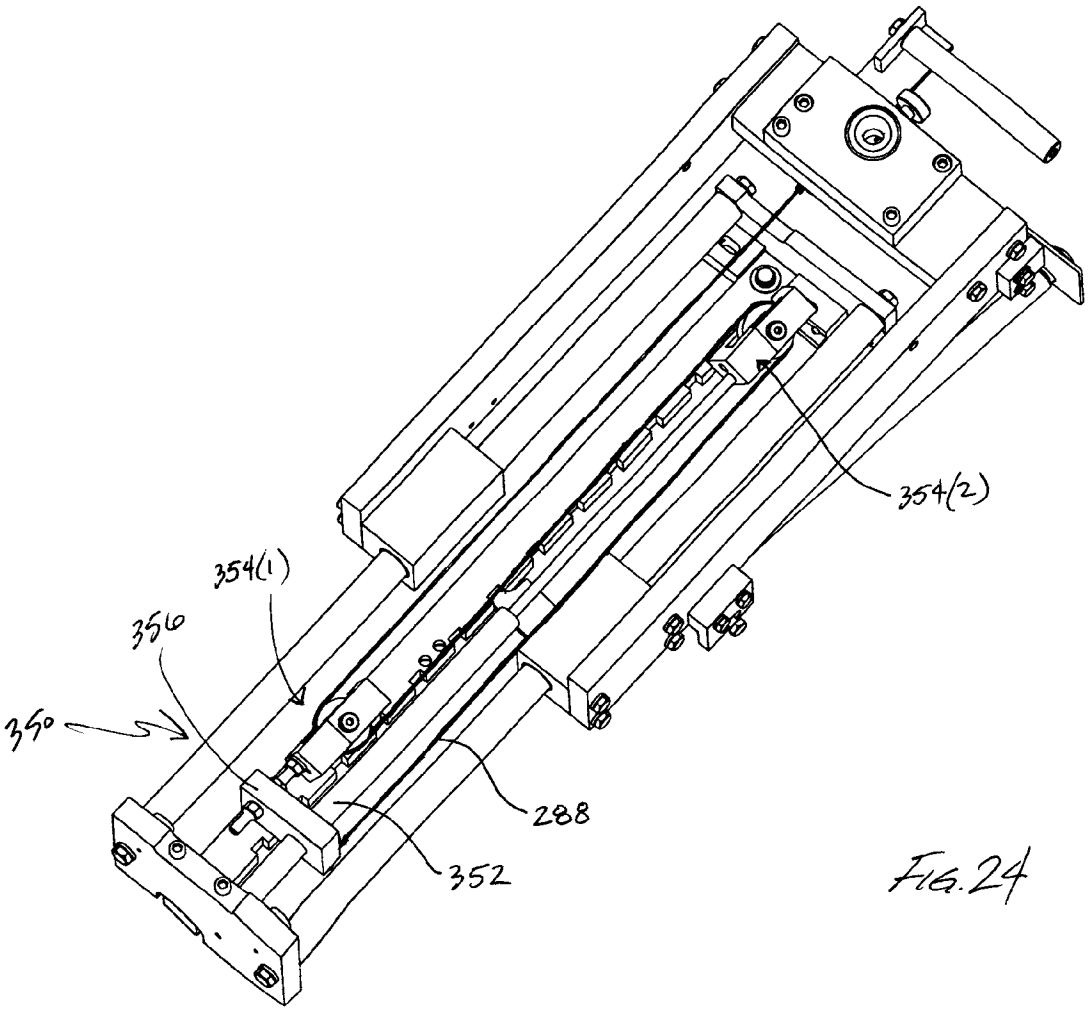
FIG. 24 is a perspective view of the edge guide mechanism with the adjustment slide removed for clarity.

As shown in FIGS. 23 and 24, the carriage is actuated in an inboard direction by actuator assembly 350. Actuator assembly 350 includes gas, or pneumatic, spring actuator 352 which engages a receptacle 242 located in end plate 234 (see FIG. 19). Gas spring actuator 352 extends toward the opposite end plate 236. An anchor plate 356 is attached to the cylinder portion of actuator 352. Anchor plate 356 supports a pulley assembly 354(1). A second pulley assembly 354(2) is attached to the rod end of actuator 352. An elongate flexible cable 288 extends from anchor plate 356 around pulley 354(2), around pulley 354(1), and terminates at cross member 203, as shown in FIGS. 23 and 24. As perhaps best shown in FIG. 23, cable 288 is anchored to anchor block 356 by fastener 284. At the other end, cable 288 is fastened to cross member 203 with fastener 286. With reference to FIG. 17, the actuator assembly 350 includes a pair of pulley assemblies 354(1) and 354(2). Each pulley assembly includes a clevis 358 which receives a pulley 362. Pulley 362 is retained in clevis 358 with shoulder screw 364. Shoulder screw 364 also captures a pulley guard 357 which extends over pulley 362. Elongate cable 288 may be formed of any suitable cable material such as, in this case, a braided stainless steel wire with eyelets crimped to both ends. It should be understood that gas spring 352 is biased toward the extended position. Accordingly, the carriage is continuously urged toward the inboard direction (i.e. laterally inward) with respect to the forming machine. Therefore, to move carriage 200 in the outboard direction the gas spring is compressed by the cable and pulley arrangement of actuator assembly 350. While actuator assembly 350 is described in this case to include a cable, pulleys and a gas spring, other actuator assemblies may be employed, such as for example and without limitation, pneumatic or hydraulic cylinders and compression, torsion, or leaf springs.

Figure 25:
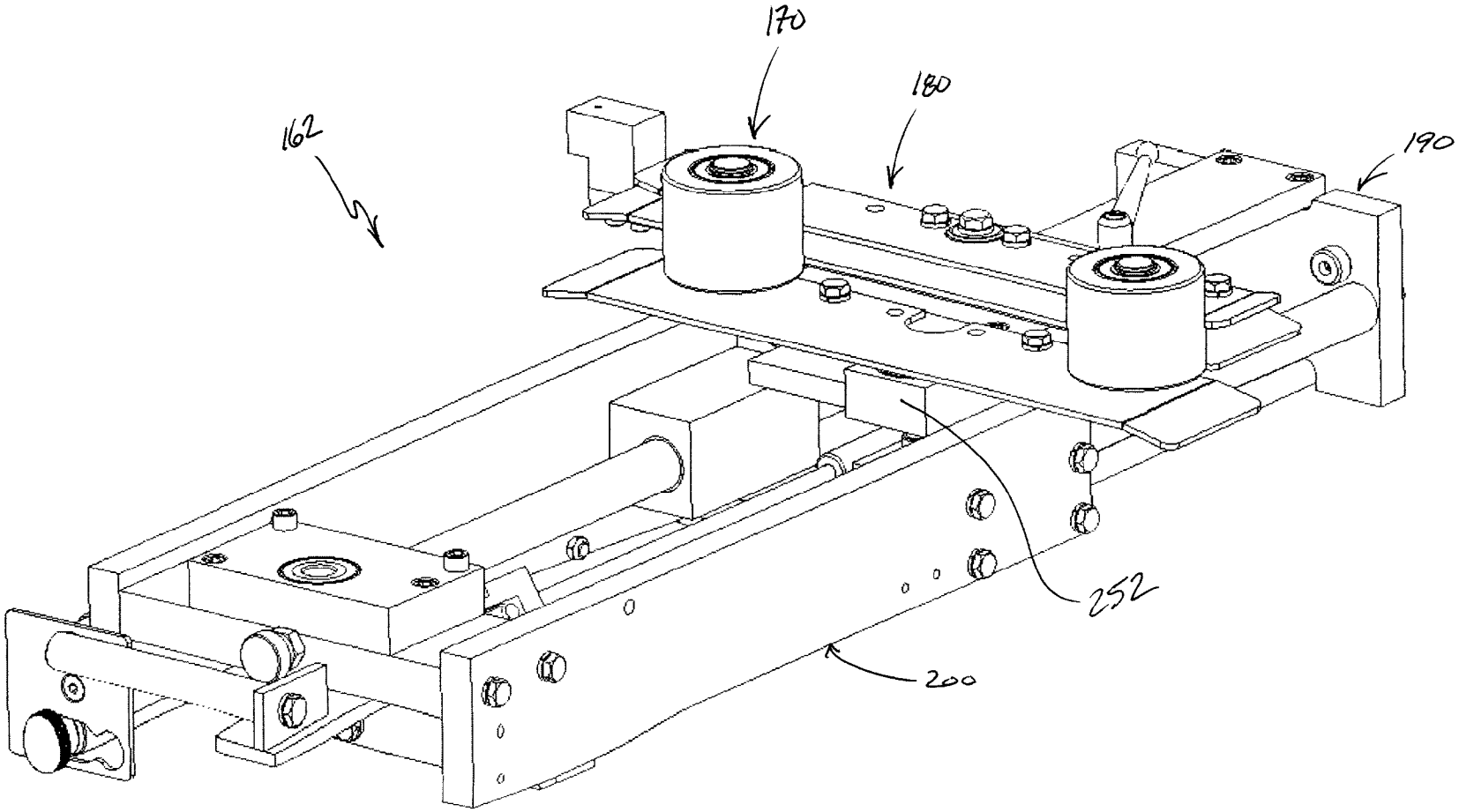
FIG. 25 is a perspective view of an edge guide mechanism configured as an exit guide.

Referring again to FIG. 23, the edge guide mechanism 160 is mounted to frame 30 through three mounting holes 292(1)-292(3). As can be seen in FIG. 4, frame assembly 34 includes three corresponding mounting pads 58(1)-58(3) at the entrance and three corresponding mounting pads 59(1)-59(3) at the exit end of the frame 30. This permits the edge guide mechanism 160 to be installed on either end of the frame. Accordingly, the roll forming machine may be configured to run the machine in either direction, depending on whether the machine is configured with left side or right side tooling, as explained above. As shown in FIG. 3, an edge guide assembly 162 is installed at the exit end of the machine. In this case, edge guide assembly 162 is configured as an exit guide. FIG. 25 illustrates exit guide 162, which is similar to edge guide 160 except that the pivoting edge guide 170 has been removed and installed, instead, in exit guide receptacle 252.

In operation, an operator adjusts the initial position of the edge guide mechanism 160. With reference to FIG. 11, the edge guide mechanism is adjusted to allow the large end of panel 7 to be fed into the guide mechanism. In order to adjust the initial position of the edge guide, an operator may pull the carriage 200 outwardly by handle 276. The operator may pull the carriage out against the biasing member 314 such that pawl 308 ratchets along ratchet bar 238. Alternatively, the operator may momentarily disengage the pawl by urging handle 303 to the right most end of elongate portion 321 of gate 307. Once the panel is in position, the operator moves knob 303 to the unlatched state by engaging knob 303 in short portion 323 of gate 307. It should be understood that if the panel 7 were fed into the machine narrow end first the latch mechanism could be left in the latched state and the carriage would ratchet along the ratchet bar as the carriage moved outwardly.

When unlatched the edge guide mechanism 160 applies pressure in a lateral direction to urge the panel against stationary edge guide 180. By pulling the carriage 200 outwardly, actuator 352 is compressed via cable 288. Accordingly, the compressed gas in actuator 352 is constantly trying to return the rod end of the actuator to an extended position. In doing so the actuator is constantly pushing against cable 288 which acts to urge the carriage inwardly. In this case, since panel 7 is fed into forming machine 10 wide end first, carriage 200 will move inwardly as the panel advances through the forming machine.

Once the edge guide mechanism has received the margins of the panel and the edge guide mechanism is unlatched such that it is applying pressure to the panel, the motor assembly 70 may be activated and the panel further urged into drive station 51. Once drive station 51 engages panel 7 the panel advances through the machine and subsequent drive stations 52-56. As the panel advances through the machine guide rollers 172(1) and 172(2) receive the edge margin of panel 7. The edge guide also pivots so as to follow the tapered angle of the panel. Also, as the panel advances through the machine tooling assembly 80 engages the longitudinal edge margin of the panel to progressively form the margin into the desired profile. It should be noted that as the panel advances through the machine the panel may extend beyond the side of frame 30 as shown in FIG. 11. Accordingly, the forming machine 10 may accommodate larger tapered panels and/or panels with a more extreme taper angle than that shown in FIG. 11. As the panel exits the forming region exit edge guide mechanism 162 receives the now formed profile of longitudinal edge margin 2 of panel 7 with rollers 172(1) and 172(2).

Generally the forming machine 10 described herein provides certain advantages over the prior art. For example, the open frame 30 allows material to extend to the side of the forming region without being obstructed by any frame members. Therefore, the forming machine may form sheets of material much wider than the forming machine itself. Thus, the overall width of the forming machine is reduced. Furthermore, the narrow width of the drive rollers allows the machine to form tapered panels and narrow straight panels. The disclosed roll forming machine's tooling is interchangeable with other machines, such as New Tech Machinery's SSQ, SSH, and SSR. Accordingly, the roll forming machine is an economical companion to the SSQ, SSH, and SSR forming machines that expands the capability of those machines. The edge guide mechanism automatically guides and locates the panel in the machine. The edge guide mechanism also allows for efficient reconfiguration to accommodate different edge profiles (or flat edge margins) by changing between edge guides. Latch mechanism 220 permits easy loading of the machine. The edge guide mechanism 160 may be installed on either end of the frame so that the roll forming machine may be configured to run in either direction.

Methods relating to the above described tapered panel roll forming machine are also contemplated. The methods thus encompass the steps inherent in the above described mechanical structures and operation thereof. Broadly, one method for forming a desired profile into a longitudinal margin of a tapered strip of material could include providing a stationary edge guide and a set of forming rollers, wherein the stationary edge guide is positioned relative to the forming rollers such that the forming rollers engage the longitudinal margin to progressively form said longitudinal margin into the desired profile. Horizontal pressure is applied to an edge margin of the tapered strip of material that is opposite the longitudinal margin thereby holding the longitudinal margin against the stationary edge guide while the strip is advanced through the forming rollers.

A method for forming a tapered panel having a desired profile on both edges may broadly include providing a panel forming machine having left and right side tooling assemblies such as described in co-pending U.S. patent application Ser. No. 12/547,710; providing a tapered panel sheet material slitter such as described in co-pending U.S. patent application Ser. No. 13/019,513, filed Feb. 2, 2011, entitled GUIDE ASSEMBLY AND SHEET MATERIAL SLITTER INCORPORATING THE SAME, the disclosure of which is hereby incorporated by reference in its entirety; and providing a tapered panel forming machine as described herein, all of which are available from New Tech Machinery Corporation. The method includes removing one of the left and right side tooling assemblies from the panel forming machine and installing the selected tooling assembly in the tapered panel roll forming machine. The method further includes forming a first desired profile along a first edge margin of a strip of sheet material in the panel forming machine. The strip of sheet material is cut in the sheet material slitter to form a tapered panel. The method further includes forming a second desired profile along a second edge margin of the panel with the tapered panel roll forming machine of the present application.

Although the technology and methods of using and/or applying the same have been described in language that is specific to certain structures, materials, and methodological steps, it is to be understood that the invention defined in the appended claims is not necessarily limited to the specific structures, materials, and/or steps described. Rather, the specific aspects and steps are described as forms of implementing the claimed invention. Since many embodiments of the invention can be practiced without departing from the spirit and scope of the invention, the invention resides in the claims hereinafter appended.

What is claimed is:

1. A roll forming machine adapted to form a longitudinal margin of a strip of material into a desired profile, comprising:

a frame including a forming region through which the strip may be advanced in a downstream direction from an upstream entrance to a downstream exit, wherein said frame includes an elongate vertical side frame portion with upper and lower frame portions extending horizontally from said vertical side frame portion, and wherein said frame is open on a side opposite said vertical side frame;

a stationary edge guide disposed proximate to said entrance;

a drive mechanism mounted to said frame and operative to engage the strip and advance the strip in the downstream direction;

a plurality of forming elements supported by said frame to define at least one forming station that is positioned to engage said longitudinal margin and operative to progressively form said longitudinal margin into the desired profile as said strip is advanced through the forming region by said drive mechanism; and an edge guide mechanism adapted to receive an edge margin of the strip that is opposite said longitudinal margin and operative to apply pressure along the edge margin in a lateral direction to urge said longitudinal margin against said stationary edge guide, thereby following the edge margin as the strip is advanced through the forming region.

2. The roll forming machine according to claim 1, wherein said edge guide mechanism includes a floating edge guide that moves laterally to follow said edge margin of the strip.

3. The roll forming machine according to claim 1, wherein said edge guide mechanism includes a carriage assembly attached to said frame and operative to apply said pressure.

4. The roll forming machine according to claim 3, wherein said carriage assembly comprises:

a carriage support frame attached to the roll forming machine; a carriage movably disposed on said carriage support frame and operative to apply said pressure; and, at least one guide roller mounted to said carriage and adapted to receive the edge margin of the strip.

5. The roll forming machine according to claim 1, wherein said edge guide mechanism includes at least one guide roller configured to receive said edge margin.

6. The roll forming machine according to claim 5, wherein said edge guide mechanism includes a carriage supporting said at least one guide roller, and an actuator connected to said carriage and operative to urge said carriage toward said plurality of forming elements.

7. The roll forming machine according to claim 6 wherein the strip of material is tapered from a first width to a second width, said roll forming machine further comprising a stationary edge guide disposed proximate said entrance, and wherein said carriage is movable such that a distance between said at least one guide roller and said stationary edge guide varies between the strip's first and second widths.

8. The roll forming machine according to claim 7, wherein said edge guide mechanism includes a pair of said guide rollers mounted on a guide bar pivotably mounted on said carriage, whereby said guide rollers may receive the edge margin.

9. The roll forming machine according to claim 8, wherein said guide rollers are configured to receive a profile of the edge margin.

10. The roll forming machine according to claim 1, further comprising a plurality of support rails to support the strip as it advances through said forming region.

11. A roll forming apparatus adapted to form a longitudinal margin of a strip of material into a desired profile, comprising:

a frame including a forming region through which the strip may be advanced in a downstream direction from an upstream entrance to a downstream exit;

a drive mechanism mounted to said frame and operative to engage the strip and advance the strip in the downstream direction;

a plurality of forming elements supported by said frame to define at least one forming station that is positioned to engage said longitudinal margin and operative to progressively form said longitudinal margin into the desired profile as said strip is advanced through the forming region by said drive mechanism; and a guide roller station adapted to receive an edge margin of the strip that is opposite said longitudinal margin and operative to apply pressure along the edge margin in a lateral direction, thereby following the edge margin as the strip is advanced through the forming region.

12. The roll forming apparatus according to claim 11 wherein said guide roller station includes a carriage support frame attached to the roll forming machine and a carriage movably disposed on said carriage support frame and operative to apply said pressure.

13. The roll forming apparatus according to claim 12 further comprising a pair of guide rollers pivotably mounted to said carriage for common movement with one another.

14. The roll forming apparatus according to claim 13 wherein said guide rollers pivot about a central pivot axis.

15. A roll forming apparatus adapted to form a longitudinal margin of a strip of material into a desired profile, comprising:

a frame including a forming region through which the strip may be advanced in a downstream direction from an upstream entrance to a downstream exit;

a drive mechanism mounted to said frame and operative to engage the strip and advance the strip in the downstream direction;

a plurality of forming elements supported by said frame to define at least one forming station that is positioned to engage said longitudinal margin and operative to progressively form said longitudinal margin into the desired profile as said strip is advanced through the forming region by said drive mechanism; and an edge guide mechanism, comprising:

a carriage assembly including:

a carriage support frame attachable to the frame;

a carriage movably disposed on said carriage support frame and operative to apply pressure in a lateral direction along an edge margin of the strip that is opposite the longitudinal margin as the strip is advanced through the forming region; and at least one guide roller mounted to said carriage and adapted to receive the edge margin of the strip; and a stationary edge guide disposed on said carriage support frame opposite said at least one guide roller, said at least one guide roller thereby operative to urge the longitudinal margin against said stationary edge guide.

16. The roll forming apparatus according to claim 15 wherein said edge guide mechanism further comprises an actuator extending from said carriage support frame that is operative to urge said carriage toward said stationary edge guide.

17. The roll forming apparatus according to claim 15 wherein said edge guide mechanism further comprises a pair of said guide rollers mounted on a guide bar that is pivotably mounted on said carriage whereby said guide rollers may receive and follow the edge margin.

18. The roll forming apparatus according to claim 17, wherein said guide rollers are configured to receive a profile of the edge margin.

19. The roll forming apparatus according to claim 17 wherein the edge margin is tapered from a first width to a second width, and wherein said carriage is movable such that the distance between said guide rollers and said stationary edge guide varies between the first and second widths.

* * * * *